US012207738B2

(12) United States Patent
Richardson

(10) Patent No.: US 12,207,738 B2
(45) **Date of Patent: *Jan. 28, 2025**

(54) STOOLS AND CHAIRS WITH TRANSLATABLE ARMRESTS

(71) Applicant: InkBed, Inc., Everett, WA (US)

(72) Inventor: Kevin Richardson, Everett, WA (US)

(73) Assignee: INKBED, INC., Mukilteo, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/331,378

(22) Filed: Jun. 8, 2023

(65) Prior Publication Data

US 2024/0081541 A1 Mar. 14, 2024

Related U.S. Application Data

(63) Continuation of application No. 16/992,850, filed on Aug. 13, 2020, now Pat. No. 11,707,136, which is a continuation of application No. PCT/US2019/018100, filed on Feb. 14, 2019.

(60) Provisional application No. 62/729,253, filed on Sep. 10, 2018, provisional application No. 62/630,801, filed on Feb. 14, 2018.

(51) Int. Cl.

| | |
|---|---|
| ***A47C 31/00*** | (2006.01) |
| ***A47C 1/00*** | (2006.01) |
| ***A47C 7/54*** | (2006.01) |

(52) U.S. Cl.

CPC ..... *A47C 7/543* (2013.01); *A47C 7/541* (2018.08)

(58) Field of Classification Search

CPC ..... A47C 9/005; A47C 7/54

USPC ..... 297/411.32, 411.4, 344.21

See application file for complete search history.

(56) References Cited

U.S. PATENT DOCUMENTS

| | | | |
|---|---|---|---|
| 3,188,136 | A | 6/1965 | Refield et al. |
| 3,227,440 | A | 1/1966 | Scott |
| 3,319,747 | A | 5/1967 | Lauper |
| 4,159,145 | A | 6/1979 | Quakenbush |
| 4,170,800 | A | 6/1979 | Quakenbush |
| 4,285,541 | A | 8/1981 | Onishi |
| 4,387,888 | A | 6/1983 | Marinakis |

(Continued)

FOREIGN PATENT DOCUMENTS

| | | | |
|---|---|---|---|
| CN | 2151738 | Y | 1/1994 |
| CN | 201119969 | Y | 9/2008 |

(Continued)

OTHER PUBLICATIONS

"Hydraulic All Purpose Tattoo Chair KI New York", http://www.puretat.com, accessed Jan. 18, 2010, 2 pages.

(Continued)

*Primary Examiner* — Shin H Kim

(74) *Attorney, Agent, or Firm* — Perkins Coie LLP

(57) ABSTRACT

An apparatus that supports a user in a variety of positions to comfortably perform tasks, such as applying one or more tattoos to skin of a subject is herein disclosed. The apparatus can be reconfigured to optimally position and support the arms and/or chest of the user. The apparatus includes a vertically movable armrest assembly. Armrests can support the user's forearms while supporting the user's chest such that the user can comfortably perform tasks in front of a chest support of the stool. The armrest assembly can be translated vertically to accommodate the user's body to achieve desired positioning.

20 Claims, 28 Drawing Sheets

(56) References Cited

U.S. PATENT DOCUMENTS

| | | | | |
|---|---|---|---|---|
| 4,516,805 | A | 5/1985 | Leeper et al. | |
| 4,650,249 | A | 3/1987 | Serber | |
| 4,660,549 | A | 3/1987 | Serber | |
| 4,795,214 | A | 1/1989 | Holdt et al. | |
| 4,832,407 | A | 1/1989 | Holdt | |
| 5,060,327 | A | 10/1991 | Celestina | |
| 5,086,769 | A | 2/1992 | Vianello et al. | |
| 5,098,158 | A | 2/1992 | Vianello et al. | |
| 5,315,722 | A | 5/1994 | Djie | |
| 5,401,078 | A | 3/1995 | Riach | |
| 5,487,590 | A | 1/1996 | Haynes | |
| 5,642,542 | A | 7/1997 | Kometani | |
| 5,645,313 | A | 7/1997 | Kometani | |
| 5,653,499 | A | 7/1997 | Best et al. | |
| 5,678,894 | A | 8/1997 | Goodall | |
| 5,762,402 | A | 6/1998 | Gillotti | |
| 5,967,610 | A | 10/1999 | Lin | |
| 5,971,475 | A | 10/1999 | Lin | |
| 5,971,485 | A | 10/1999 | Lawson et al. | |
| 6,003,940 | A | 12/1999 | Jackson | |
| 6,089,593 | A | 7/2000 | Hanson | |
| 6,135,548 | A | 7/2000 | Hanson et al. | |
| 6,212,713 | B1 | 4/2001 | Kuck et al. | |
| 6,315,319 | B1 | 4/2001 | Kuck et al. | |
| 6,446,287 | B2 | 9/2002 | Borders et al. | |
| 6,543,853 | B1 | 4/2003 | Splane, Jr. | |
| 6,619,747 | B2 | 4/2003 | Splane, Jr. | |
| 6,767,066 | B1 | 7/2004 | Tornero et al. | |
| 6,824,219 | B2 | 7/2004 | Tornero | |
| 6,846,042 | B2 | 1/2005 | Hanson et al. | |
| 6,918,143 | B2 | 1/2005 | Hanson et al. | |
| 7,021,037 | B1 | 4/2006 | Szymas | |
| 7,080,885 | B2 | 4/2006 | Szymas | |
| 7,234,768 | B2 | 6/2007 | Manning et al. | |
| 7,293,834 | B2 | 6/2007 | Manning et al. | |
| 7,357,456 | B1 | 4/2008 | Freer et al. | |
| 7,600,817 | B2 | 10/2009 | Kramer et al. | |
| 7,784,871 | B2 | 8/2010 | Cochran et al. | |
| 8,651,569 | B2 | 2/2014 | Andoloro et al. | |
| 9,084,486 | B1 | 7/2015 | Richardson et al. | |
| 9,375,088 | B2 | 6/2016 | Andoloro et al. | |
| 9,451,831 | B2 | 6/2016 | Andoloro | |
| 9,498,398 | B1 | 9/2016 | Richardson et al. | |
| 9,814,313 | B2 | 11/2017 | Richardson et al. | |
| 9,853,438 | B2 | 11/2017 | Richardson et al. | |
| 10,238,213 | B2 | 3/2019 | Richardson et al. | |
| 10,264,885 | B2 | 3/2019 | Richardson et al. | |
| 10,383,444 | B1 | 4/2019 | Andoloro et al. | |
| 10,506,881 | B2 * | 12/2019 | Richardson | A47C 7/405 |
| 10,517,404 | B2 | 12/2019 | Richardson et al. | |
| 10,524,573 | B2 | 1/2020 | Richardson et al. | |
| 10,638,843 | B2 | 1/2020 | Richardson et al. | |
| 10,918,213 | B2 * | 2/2021 | Fryer | A47C 9/002 |
| 10,959,523 | B2 | 2/2021 | Fryer | |
| 10,973,725 | B2 | 3/2021 | Richardson et al. | |
| 11,564,495 | B1 | 1/2023 | Arnett | |
| 11,707,136 | B2 | 7/2023 | Richardson | |
| 11,805,904 | B2 | 7/2023 | Richardson et al. | |
| 11,730,269 | B1 | 8/2023 | Rosebrook | |
| 11,850,105 | B2 | 12/2023 | Bruni | |
| 2002/0000008 | A1 | 1/2002 | Borders | |
| 2002/0067060 | A1 | 6/2002 | Lloyd | |
| 2002/0158492 | A1 * | 10/2002 | Ko | A61B 90/60 297/112 |
| 2004/0133979 | A1 | 7/2004 | Newkirk et al. | |
| 2005/0104435 | A1 | 5/2005 | Bain et al. | |
| 2006/0225212 | A1 | 10/2006 | Parson et al. | |
| 2007/0035164 | A1 | 2/2007 | North | |
| 2007/0052275 | A1 * | 3/2007 | Ghilzai | A47C 1/11 297/423.12 |
| 2007/0108805 | A1 | 5/2007 | Manning | |
| 2009/0250565 | A1 | 10/2009 | Jaggers et al. | |
| 2009/0295213 | A1 | 12/2009 | White | |
| 2010/0295357 | A1 * | 11/2010 | Koehler | A47C 9/005 297/463.1 |
| 2011/0272976 | A1 | 11/2011 | Wei et al. | |
| 2016/0157618 | A1 * | 6/2016 | Arnett | A47C 9/002 297/325 |
| 2018/0255932 | A1 | 9/2018 | Hopper | |
| 2024/0130530 | A1 | 4/2024 | Richardson et al. | |

FOREIGN PATENT DOCUMENTS

| | | | |
|---|---|---|---|
| JP | 5284532 | B1 | 9/2013 |
| WO | 2009056004 | A1 | 5/2009 |
| WO | 2011087232 | A2 | 7/2011 |
| WO | 2013078569 | A1 | 6/2013 |

OTHER PUBLICATIONS

"Tatsoul 370" http://www.tatsoul.com, accessed Feb. 2, 2010, 7 pages.

"Tattoo-Chairs-table", http://www.tattoochair.com, © 2009, accessed Jan. 18, 2010, 7 pages.

"Traveler—The Ultimate Table", http://www.tattootable.com, Fab Tech, accessed Jan. 18, 2010, 3 pages.

Extended European Search Report for European Application No. 15735366.5; Date of Mailing; Jul. 6, 2017; 7 pages.

First Examination Report mailed Sep. 12, 2018 in Australian Patent Application No. 2015204573, 4 pages.

International Search Report and Written Opinion mailed Jun. 3, 2019 in International Patent Application No. PCT/US19/18100, 15 pages.

International Searching Authority, International Search Report and Written Opinion, PCT Patent Application PCT/US2015/010910, mailed May 11, 2015, 14 pages.

Office Action mailed Apr. 26, 2019 in Chinese Patent Application No. 201580003983.7, with English Translation, 21 pages.

Office Action mailed Feb. 17, 2021 in Canada Patent Application No. 2,935, 140, 3 pages.

Office Action mailed Jun. 4, 2020 in Chinese Patent Application No. 201580003983.7, with English Translation, 21 pages.

Office Action mailed Dec. 8, 2023 in Chinese Patent Application No. 202110098185.4, with English Translation, 22 pages.

Office Action mailed May 18, 2022 in Canada Patent Application No. 2,935, 140, 6 pages.

Office Action mailed Sep. 24, 2021 in Canada Patent Application No. 2,935,140, 4 pages.

Office Action mailed Sep. 30, 2019 in Chinese Patent Application No. 201580003983.7, with English Translation, 8 pages.

Office Action mailed Sep. 6, 2018 in Chinese Patent Application No. 201580003983.7, with English Translation, 21 pages.

TATSoulSupply. TATSoul Artist Chair Review—YouTube. YouTube, Mar. 20, 2013. [Retrieved Mar. 13, 2015]. Retrieved from Internet <URL: https://www.youtube.com/watch?v=JBNqVAItTQw>.

* cited by examiner

STOOLS AND CHAIRS WITH TRANSLATABLE ARMRESTS

RELATED APPLICATIONS

This application is a continuation application of U.S. patent application Ser. No. 16/992,850, entitled "STOOLS AND CHAIRS WITH TRANSLATABLE ARMRESTS," filed on Aug. 13, 2020, which is a continuation application of International Patent Application No. PCT/US2019/018100, entitled "STOOLS AND CHAIRS WITH TRANSLATABLE ARMRESTS," filed Feb. 14, 2020, and claims the benefit of U.S. Provisional Patent Application No. 62/729,253, entitled "STOOLS AND CHAIRS WITH TRANSLATABLE ARMRESTS," filed on Sep. 9, 2018, and U.S. Provisional Patent Application No. 62/630,801, entitled "STOOLS AND CHAIRS WITH TRANSLATABLE ARMRESTS," filed on Feb. 14, 2018. The above-referenced applications are hereby incorporated by reference in their entireties.

TECHNICAL FIELD

The present technology is related to support apparatuses and associated methods of using the same. In particular, the present technology is related to reconfigurable stools and chairs having movable support components, such as translatable armrests.

BACKGROUND

Conventional stools and chairs are not designed to support an occupant's chest and arms when the occupant leans forward. In tattoo parlors, tattoo artists often sit on stools or chairs while applying tattoos. Unfortunately, conventional stools and chairs are not ergonomically designed for tattoo artists and are not comfortable when, for example, leaning forward and applying tattoos. For example, a tattoo artist's arms and shoulders can experience significant fatigue when applying large intricate tattoos. Additionally, when a tattoo artist leans forward for a significant period of time, the artist's lower back may experience fatigue and discomfort. In medical environments, physicians, nurses, or other medical personnel frequently sit and lean forward to perform tasks, which may cause lower back pain. Accordingly, there is a need for stools or chairs that comfortably support an occupant's body without hindering movement of the occupant's shoulders, arms, hands, or other body parts.

Overview of Technology

An exemplary embodiment is a support apparatus for supporting a user. The support apparatus can place the user's body in ergonomic positions to help reduce or limit fatigue (e.g., muscle fatigue in the user's arms, shoulders, back, etc.), discomfort, and/or pain. The user can straddle the apparatus and can lean forward against a padded chest support. The padded chest support can be narrower than the user's chest and/or shoulders to provide unrestricted movement of the user's arms on the front side of the chest support. The support apparatus can have armrests that are shorter than the user's forearms to provide unrestricted movement of the user's wrists and/or hands while the user's forearms rest on the armrests. The user can sit in different directions on the support apparatus. When sitting facing the chest support, the user can lean forward against the chest support. When facing the opposite direction, the chest support can function as a back support, and the armrests can be stowed to help support the sides of the user's back.

The support apparatus can be a stool, a chair, or other reconfigurable equipment capable of supporting the user's body in ergonomic positions. In tattoo parlors, the support apparatus can place a tattoo artist's body in different ergonomic positions to help eliminate, reduce, or limit fatigue associated with tattooing. The support apparatus can also be used by a client (i.e., a person obtaining a tattoo). In one embodiment, a tattooing stool can support a tattoo artist in a variety of positions to comfortably apply one or more tattoos to skin of a client. The apparatus can be reconfigured to optimally position and support the arm (s) and/or chest of the tattoo artist. A method for using a tattoo stool can involve rotating armrests between a stowed position for supporting the tattoos artist's chest and/or shoulders to a deployed position for supporting the tattoo artist's arms. For example, armrests can support the user's forearms while a chest support supports the user's chest such that the artist can comfortably tattoo a body part of the subject positioned in front of the tattoo stool. In medical settings, a doctor, a nurse, lab technician, or other medical personnel can use the support apparatus to perform tasks, such as laboratory work, blood drawing, etc. The support apparatus can also be used in massage parlors, salons, spas, or other desired locations.

In some embodiments, a stool comprises a seat assembly and a chest support assembly. The chest support assembly can include a padded support and at least one armrest movable between a stowed position and a deployed position. The padded support is configured to support the chest of a user (e.g., a tattoo artist) sitting on the seat assembly while allowing the user's arms to move freely on a front side of the padded support. The armrest, in the deployed position, can extend away from the padded support such that the user's arm is capable of resting on the portion of the armrest located in front of the padded support. The user can adjust the configuration of the stool any number of times during use (e.g., a tattoo session). The seat assembly, in some embodiments, includes a seat, a pedestal, hydraulics, mechanisms (e.g., locking mechanisms, tilt adjustment mechanisms, etc.), and/or a plurality of wheels for rolling along a support surface. When straddling the stool (e.g., a user straddles a vertical support of the chest assembly), the user can conveniently wheel the stool along the support surface. The seat assembly can include a swiveling padded seat to permit convenient rotation. In the stowed position, the armrest can be positioned alongside the padded support. In the deployed position, an elongated main body of the armrest can extend substantially perpendicular to the padded support. The armrest can also be located at other orientations.

In some embodiments, a support apparatus comprises a seat assembly, a chest support, and an armrest. The chest support can be carried by the seat assembly and is positioned to contact the front of the user's chest while the user sits on the seat assembly. An end of the armrest can move away from the user's chest when the armrest rotates from a raised position to a lowered position. In the raised position, the armrest can support the user's chest and/or shoulders for enhanced comfort. In the fully lowered position, the armrest can be positioned to support a user's forearm. For example, the lowered armrest can be oriented generally horizontally. The end of the lowered armrest and seat assembly can be positioned on opposite sides of a chest pad of the chest support. In some embodiments, most of the length of the armrest (e.g., 70%, 80%, 90%, or 95% of the total length of the armrest) and most of the seat are located on opposite sides of an imaginary vertical plane (e.g., a vertical plane positioned along the chest support).

The support apparatus, in some embodiments, can include a pair of armrests rotatably coupled to opposing sides of the chest support. The armrests rotate together or independently relative to the chest support. For example, a pivoting mechanism can rotatably couple one armrest to the left side of the chest support, and another pivoting mechanism can rotatably couple the other armrest to the right side of the chest support. The pivoting mechanisms can have different states of operation, such as a locked state and an unlocked state. In one embodiment, the pivoting mechanisms can be biased toward the locked state.

In further embodiments, a support apparatus can comprise a seat assembly, means for supporting a user's chest, and means for supporting the user's arm. The seat assembly can carry the means for supporting the chest of the user. The means for supporting the user's arm can support a user's arm while the user sits on the seat assembly and the user's chest rests against the means for supporting the user's chest. In one embodiment, the means for supporting the user's chest includes a padded chest support and a vertical rod, which couples the padded chest support to the seat assembly. The means for supporting the user's arm can include one or more rotatable armrests, which can be padded for enhanced comfort.

In yet further embodiments, a method for using a stool or a chair is provided. The method comprises rotating at least one armrest of the stool or chair from a stowed position to a lowered position. In one embodiment, a tattoo artist can tattoo at least a portion of a subject (e.g., a client) while the lowered armrest supports the artist's arm and also while the artist's chest rests against a chest support of the stool. The artist can comfortably lean against the chest support, which is movable between vertical and inclined positions. Alternatively, the client can sit on the stool, and the client's arm can rest on the armrest while it is tattooed. The method can also be performed using a chair that includes a chest support and armrests.

In some embodiments, a stool includes a seat assembly and a chest support assembly. The chest assembly includes a chest support, an elongate member coupling the chest support to the seat assembly, and an armrest assembly. A back side of the chest support is configured to support a chest of a user sitting on the seat assembly and straddling the elongate member while allowing unobstructed movement of user's arms on a front side of the chest support. The armrest assembly has at least one armrest, a locking mechanism, and an armrest holder that couples the armrests to the locking mechanism. Each armrest can be movable between a stowed position for supporting the user's chest contacting the backside of the chest support and a deployed position for supporting the user's arm located on the front side of the chest support. The locking mechanism has an unlock state for moving the armrest assembly (e.g., moving vertically, horizontally, or both relative to the chest support) and a locked state for fixedly coupling the armrest assembly to the elongate member. The locking mechanism can have other states.

The armrest assembly can be slidably disposed on the elongate member. The locking mechanism in the locked state has a pin (e.g., a spring-loaded pin) that extends through a hole in the elongate member. The armrest assembly includes a sliding bracket that allows armrests to be moved (e.g., translated) together relative to the chest piece. The bracket can be released and moved to each position using a spring-loaded pull pin and knob. In some embodiments, the armrest holder allows rotation of the at least one armrest between the stowed position and the deployed position. The armrest in the stowed position is received by the chest support. The armrest moves away from the chest support when it moves from the stowed position to the lowered position.

The armrest holder can include an armrest positioner assembly having one or more states, such as an unlocked state, a locked state, or the like. The armrest is movable (e.g., rotatable, translatable, or both) relative to the chest support when the armrest positioner assembly is in the locked state, and the armrest is fixed with respect to chest support when the armrest positioner assembly is in the locked state. The armrest, in the deployed position, extends away from the chest support such that a portion of the armrest is located on the front side of the chest support and is positioned to support the user's forearm while the user sits on the seat assembly and the user's chest contacts the backside of the chest support. In some embodiments, most of the longitudinal length of the armrest is located on the front side of the chest support.

The armrest includes a base and a body for supporting the user's forearm, wherein the body is movable away from the base to move the at least one armrest from an unextended configuration to an extended configuration, wherein the at least one armrest is configured to be extended independent of an angular position of the at least one armrest. The chest support assembly includes an upper chest support movable away from the chest support. The upper chest support movement can be independent of a position of the armrest assembly.

The armrest assembly can include an armrest positioner defining a plurality of angular positions of one or both armrests. The armrest positioner has a locked configuration for holding an armrest stationary relative to the chest support and an unlocked configuration for allowing movement of the armrest relative to the chest support and between the angular preset positions. The armrest, in the deployed position, extends forwardly away from the user's chest when the user's chest contacts the backside of the chest support and/or when one of the user's legs is positioned underneath the armrest. The armrest is movable vertically when the armrest assembly is in the unlocked state. For example, the armrest can be generally perpendicular to the user's upper body.

The stool is configured to be straddled by the user when the user's chest contacts the backside of the chest support. The chest support and armrest are dimensioned to overlay the chest of the user while the user sits on the seat assembly. The armrest includes a mounting end rotatably coupled to the chest support and a main body. The main body extends from the mounting end. The main body is positioned alongside the chest support when the armrest is in the stowed position. The main body extends substantially perpendicular to the chest support when in the deployed position.

The armrest can be in a generally vertical orientation when in the stowed position. The armrest can be in a horizontal orientation when in the deployed position. The armrest is rotatable along an arc in a range from about 60 degrees to about 120 degrees, about 70 degrees to about 110 degrees, about 80 degrees to about 100 degrees, or about 85 degrees to about 95 degrees. For example, the armrest can be rotated about 80 degrees to about 100 degrees to move the armrest between the chest support position and a lowered position.

The stool can include a plurality of armrests. For example, the stool can include a first armrest and a second armrest positionable such that an upper surface of the at least one armrest and a backside surface of the chest support contact the user's chest and/or shoulders. The armrest can have substantially congruent configurations or otherwise similar limitations. In some embodiments, the stool includes a first armrest and a second armrest that rotate independently relative to one another, and the armrest assembly is movable along the elongated support independent of the position at the first and/or second armrest. In some embodiments, the chest support defines an armrest-receiving opening configured to receive the one armrest when that armrest moves from the deployed position to the stowed position. Each armrest, in the stowed positions, has upper surfaces that is approximately flush with a surface of the chest support.

The stool can have a lift mechanism coupling the chest support to the seat assembly. The lift mechanism in an unlocked state allows vertical movement of the chest support relative to the seat assembly. The lift mechanism in a locked state prevents vertical movement of the chest support relative to the seat assembly. The stool can include a first armrest and a second armrest. The armrest assembly further includes an extension mechanism having a first configuration for inhibiting lateral movement of the first armrest relative to the chest support and a second configuration for allowing the first armrest to move laterally away from the chest support. The extension mechanism includes a holder coupled to the chest support and a rod slidably positionable in a passageway of the holder. The holder includes a receiver and a release device for switching the extension mechanism between the first configuration and the second configuration.

The extension mechanism can include a receiver and a connector. The receiver can be coupled to the chest support and includes a holder and a release device. The connector is configured to be positioned in a passageway of the holder. The release device is operable to move the extension mechanism between different configurations.

In further embodiments, a stool includes a seat assembly, a chest support configured to contact a user's chest, and an armrest assembly. The armrest assembly has a first armrest and a second armrests. The armrest assembly is vertically movable relative to the chest support to move at least one of the first armrest or the second armrests vertically. The first armrest has an end that moves away from the chest support and the user's chest when the first armrest rotates from a raised position for supporting the user's chest to a lowered position for supporting the user's arm. The first armrest in the raised position is adjacent the chest support to contact the user's chest resting against the chest support.

The armrest assembly can include a crossbar assembly and a locking mechanism. The crossbar assembly extends between the first and second armrests. The locking mechanism is configured to lock the crossbar assembly at a plurality of positions along the chest support to set the vertical height of the crossbar assembly. The armrest assembly is movable between a raised position at which the first armrest is positionable within a first armrest-receiving portion of the chest support and a lowered position at which the first armrest is positioned outside of the armrest-receiving portion. In some embodiments, the armrest assembly is movable between a plurality of preset vertical positions.

In yet further embodiments, a stool includes means for supporting a chest of a user, a seat assembly carrying the means for supporting the chest of the user, and an armrest configured to support a user's arm positioned in front of the stool when the user sits on the stool and the user's chest rests against the means for supporting the user's chest. The armrest is movable between a lowered position for supporting the user's arm and a stowed position for supporting the user's chest. The stool can include means for vertically translating the armrest relative to the means for supporting the user's chest. In some embodiments, the means for vertically moving the armrest can include a crossbar assembly and a locking mechanism. In some embodiments, the means for vertically moving the armrest includes a mounting member surrounding an elongate member that couples the means for supporting the user's chest to the seat assembly, a pin receivable by one or more holes in the elongate member, and a handle assembly coupled to the pin.

DETAILED DESCRIPTION OF TECHNOLOGY

Figure 2:
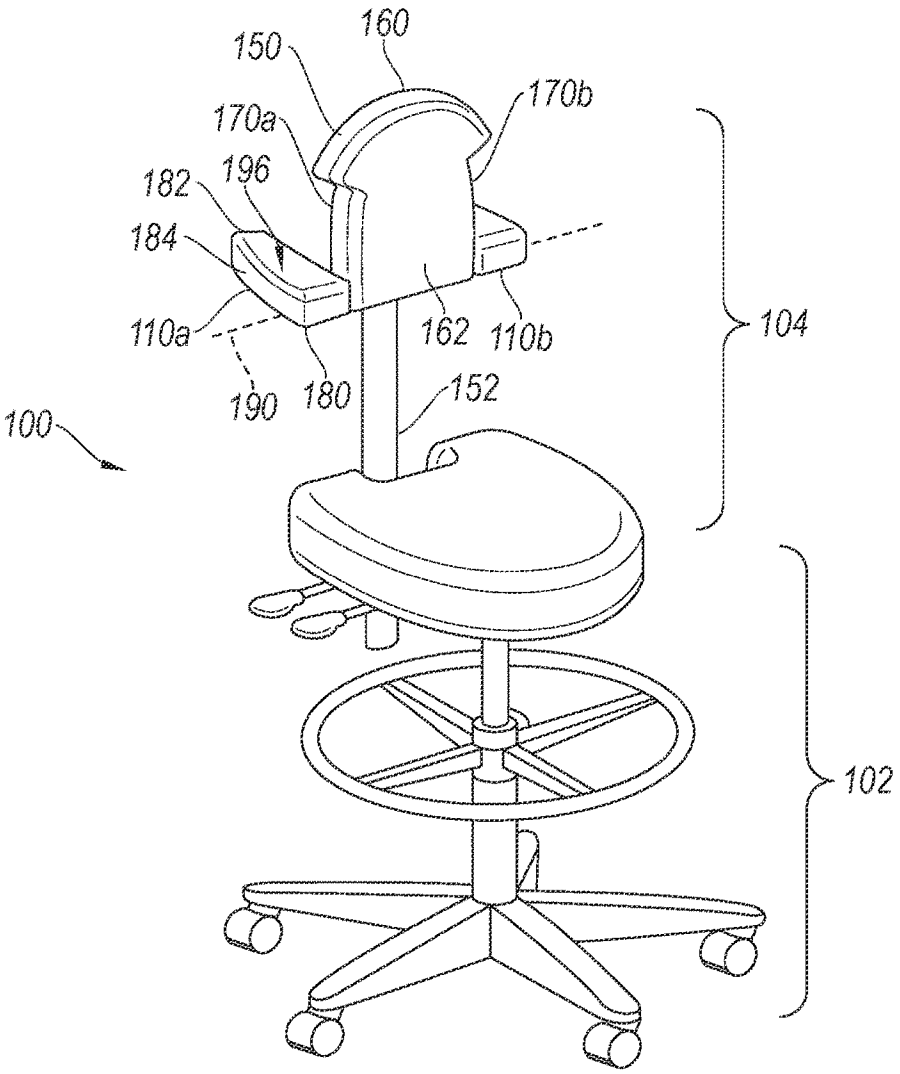
FIG. 2 is an isometric view of the stool of FIG. 1 with lowered armrests.
Figure 1:
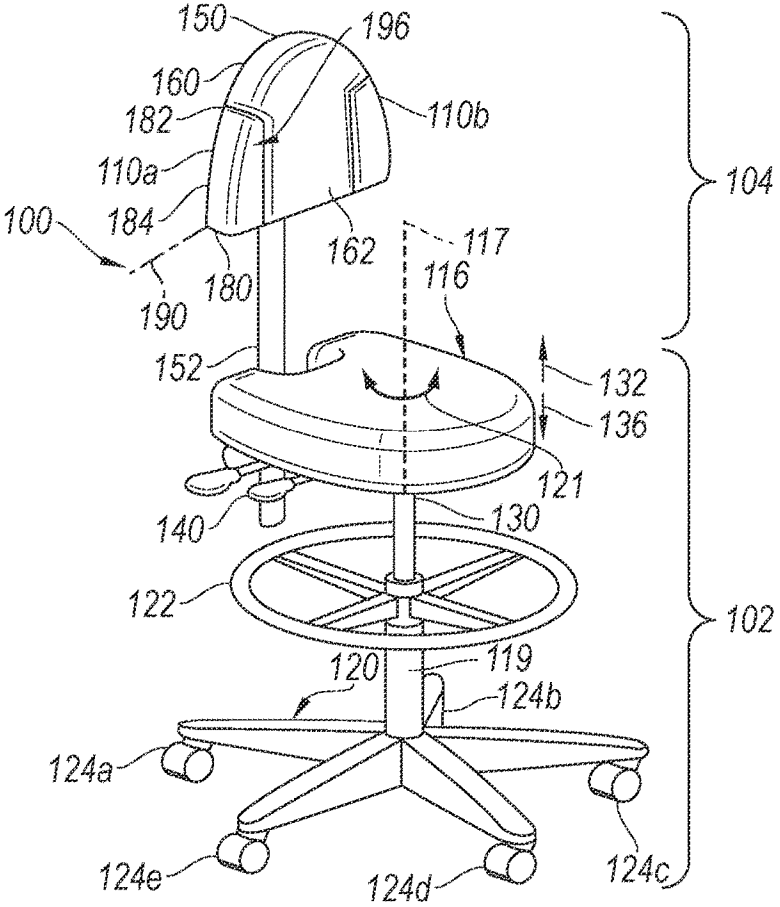
FIG. 1 is an isometric view of a stool with raised armrests in accordance with an embodiment of the present technology.

FIG. 1 is an isometric view of a stool 100 in accordance with an embodiment of the present technology. The stool 100 can include a seat assembly 102 and a chest support assembly 104. A user can sit on the seat assembly 102 such that the user's chest rests against the chest support assembly 104. The chest support assembly 104 can help position the user's upper body and can include armrests 110*a*, 110*b* (collectively "armrests 110") movable between stowed or raised positions (FIG. 1) and lowered or deployed positions (FIG. 2). The raised armrests 110 of FIG. 1 are positioned to contact and support the user's chest whereas the lowered armrests 110 of FIG. 2 can support the user's forearms. The armrests 110 can be raised and lowered any number of times to position the user's arms at different locations. If the user is a tattoo artist ("artist"), the armrests 110 can be moved to different positions to tattoo different parts of a person's body.

FIG. 1 shows the seat assembly 102 including a seat 116 and a base assembly 120. The seat 116 can be padded for comfortable sitting. The base assembly 120 can include a base member 119, a foot rest 122, and wheels 124*a*, 124*b*, 124*c*, 124*d*, 124*e* (collectively "wheels 124"). The base member 119 can include a hydraulic assembly 130 used to raise (indicated by arrow 132) and lower (indicated by arrow 136) the seat 116. The hydraulic assembly 130 can include a bearing mount or pivot that allows rotation (indicated by arrow 121) of the seat 116 about a vertical axis of rotation 117. A control element in the form of a lever 140 can be used to lower the seat 116. The foot rest 122 can be a ring fixedly coupled to the hydraulic assembly 130 or other component of the base member 119. The wheels 126 can be casters configured to roll along a support surface. The base assembly 120 can have other configurations that provide desired functionality.

Referring to FIG. 2, chest support assembly 104 can include a chest support 150 and an elongate member 152. The chest support 150 has a front side 160 facing away from an occupant and a backside 162 facing the occupant during use. The chest support 150 can include armrest-receiving portions 170*a*, 170*b* having complementary shapes with the armrests 110*a*, 110*b*, respectively. When the armrests 110 are in the stowed position (FIG. 1), the armrests 110*a*, 110*b* can be received by the armrest-receiving portions 170*a*, 170*b*, respectively, such that the chest support assembly 104 (i.e., the chest support 150 and armrests 110) has an upside down U-shape configuration or partially elliptical configuration. The size and configuration of the chest support assembly 104 can be selected based on the desired amount of cushion, size of the user, and/or desired range of motion of the user.

The armrests 110*a*, 110*b* can be generally similar to each other, and accordingly, the description of one armrest 110*a*, 110*b* applies equal to the other armrest 110*a*, 110*b*, unless indicated otherwise. The armrest 110*a* can include a mounting end 180, a terminal end 182, and an elongated main body 184 therebetween. The mounting end 180 can be pivotally coupled to the chest support 150. The elongated main body 184 can have an upper surface 196 upon which the user's arm can rest. A rod (not shown) within the chest support 150 can couple the armrests 110*a*, 110*b* together. As such, the armrests 110 can rotate together about an axis of rotation 190. In other embodiments, the armrests 110 are independently rotatable about the axis of rotation 190. For example, one armrest 110 can be in the stowed position while the other armrest 110 can be in the deployed position. The axis of rotation 190 can be a horizontally oriented axis for up and down rotation of the armrests 110, but the axis of rotation 190 can be other orientations.

Figure 3:
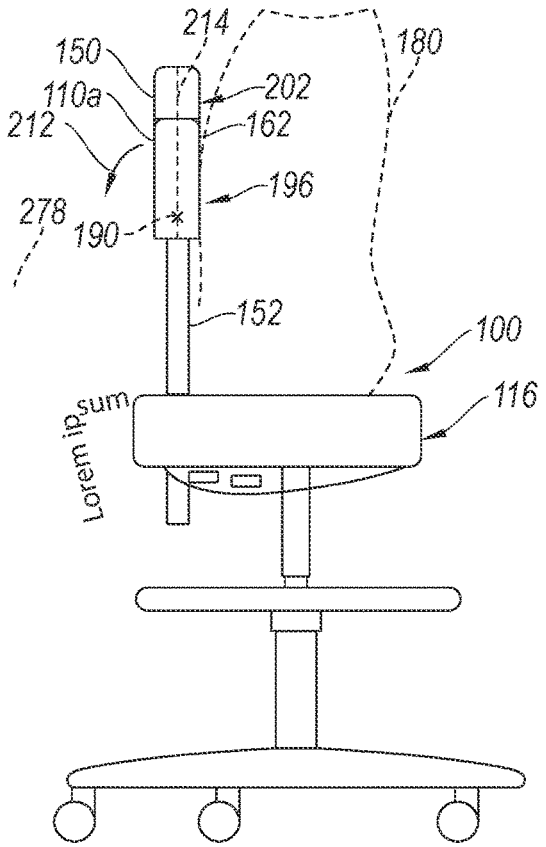
FIG. 3 is a side view of the stool of FIG. 1 with raised armrests and a user sitting on the stool.
Figure 4:
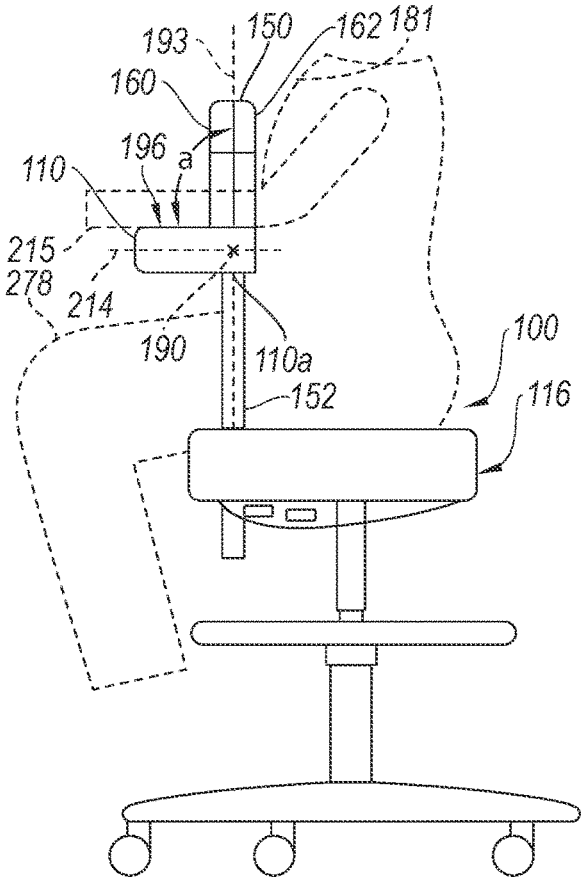
FIG. 4 is a side view of the stool of FIG. 1 with lowered armrests and the user sitting on the stool.

FIG. 3 is a side view of the stool 100 with raised armrests 110. FIG. 4 is a side view of the stool 100 with lowered armrests 110. Referring now to FIG. 3, the stowed armrests 110 can be at an upright or substantially vertical orientation. As used herein, the term "substantially vertical" includes ranges of small angles from vertical, for example, angles between about 0 degrees and 10 degrees from vertical, such as angles less than about 5 degrees, for example, angles less than about 3 degrees, 2.5 degrees, or 2 degrees. The upper surface 196 can be approximately flush with a surface 202 of the chest support 150, illustrated in a substantially vertical orientation. The chest support 150 and the armrests 110 provide a relatively large surface area for contacting the user's chest and/or shoulders.

Referring to FIGS. 3 and 4, the armrest 110 can rotate (indicated by arrow 212 in FIG. 3) about the axis of rotation 190 an angle $\alpha$ (FIG. 4). In some embodiments, the angle $\alpha$ (FIG. 4) can be about 70 degrees to about 100 degrees. In one embodiment, the armrest 110*a* is rotatable along an arc of about 80 degrees to about 90 degrees. In some embodiments, the angle $\alpha$ is about 80 degrees, 85 degrees, 90 degrees, 95 degrees, or 100 degrees. The armrest 110 can be rotated from an upright position in which a longitudinal axis 214 of the armrest 110*a* is substantially vertical (FIG. 3) to the fully deployed position in which the longitudinal axis 214 is substantially horizontal (FIG. 4). As used herein, the term "substantially horizontal" includes ranges of small angles from horizontal, for example, angles between about 0 degree and 10 degrees from horizontal, such as angles less than about 5 degrees, for example, angles less than about 2.5 degrees. In other embodiments, the fully lowered armrest 110 can be located at other orientations, such as a declined orientation, selected based on the desired body position of the user.

Referring to FIG. 4, the armrest 110 can extend substantially perpendicular to the vertically oriented chest support 150 and away from the user's torso during use. The user's chest 181 (illustrated in phantom line) can contact the backside 162 of the chest support 150, and the user's arm 215 can rest on the armrest 110, which extends outwardly on the front side 160 of the chest support 150. As such, the armrests 110 and seat 116 extend away from opposite sides of a coronal plane 193 of the chest support 150. The armrest 110 can be shorter than the user's forearm to provide unrestricted movement of the user's wrist and/or hand. In some embodiments, the length of the armrest 110 is in a range of about 5 inches (12.7 cm) to about 1 ft. (30.5 cm), but other lengths can be selected based on, for example, the length of the user's forearm. Longer armrests can be used to support the user's forearm and hand. In some embodiments, the length of the armrest 110 is between about 5 inches and 10 inches, between about 6 inches and about 10 inches, and between about 8 inches and 9 inches. In one embodiment, the armrest has a length of about 8.75 inches. As shown in FIG. 4, the user's leg 278 can be positioned generally underneath the armrest 110 to help keep the user's body properly aligned with the chest support 150. The user's arm 215 can freely move in front of the stool 100 while the chest support 150 comfortably supports the user's chest/stomach 181 to reduce, limit, or substantially eliminate fatigue (e.g., muscle fatigue in the user's arms, shoulders, and/or back), discomfort, and/or pain.

Figure 5:
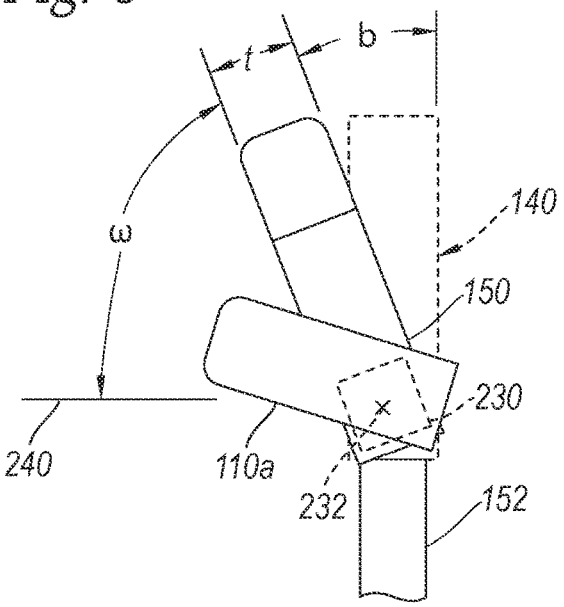
FIG. 5 is a side view of a chest support in different positions in accordance with an embodiment of the present technology.

The chest support 150 can be rotationally fixed to the elongate member 152 and can remain in a substantially vertical orientation during use. In other embodiments, the chest support 150 can be rotated relative to the elongate member 152 for enhanced comfort. FIG. 5 is a side view of the chest support 150 rotated in accordance with an embodiment of the present technology. A pivoting or tilt mechanism 230 (illustrated in phantom line) has an unlocked state and a locked state. In the unlocked state, the pivoting mechanism 230 allows rotation of the chest support 150 about an axis of rotation 232 to move the chest support 150 between a first orientation (e.g., a vertical orientation) to another orientation (e.g., a non-vertical orientation). The axis of rotation 232 can be aligned with the axis of rotation 190 (FIGS. 2 and 3). For example, the axis of rotation 232 can be generally parallel to the axis of rotation 190. However, the axes of rotation 190, 232 can be at other orientations.

The pivoting mechanism 230 can include, without limitation, one or more release mechanisms, hinges, bearings, pins, or combinations thereof and may be capable of manual locking and unlocking. In the locked state, the pivoting mechanism 230 inhibits or prevents rotation of the chest support 150 about the axis of rotation 232. In the unlocked state, the chest support 150 can be rotated about the axis of rotation 232 an angle of rotation 13 equal to or less than a maximum angle, such as about 70 degrees, 80 degrees, or 90 degrees. In push-button embodiments, the pivoting mechanism 230 can include a button that can be depressed to switch the state of the pivoting mechanism 230. The configuration and operation of the pivoting mechanism 230 can be selected based on the desired reconfigurability of the stool 100. Pivoting mechanisms can also be incorporated into armrests, and in certain embodiments, such pivoting mechanisms can lock armrests at multiple orientations (e.g., a declined orientation, a horizontal orientation, an inclined orientation, a vertical orientation, etc.).

The chest support 150 can be positioned at different angles of inclination w (i.e., the angle defined by the chest support 150 and a generally horizontal imaginary plane 240). In some embodiments, the angle of inclination w is equal to or greater than about 30 degrees, 40 degrees, 50 degrees, 60 degrees, 70 degrees, 80 degrees, or 85 degrees. In particular embodiments, the angle of inclination ω is in a range of about 45 degrees to about 90 degrees. The chest support 150 can be repositioned at any time during use to minimize, limit, or substantially eliminate fatigue discomfort and/or pain. If the user has to lean over for a significant length of time, the inclination of the chest support 150 can be varied as desired, and the armrest 110*a* (or armrest 110*b*) can be locked at a desired position relative to the inclined chest support 150. For example, the angle of inclination ω can be about 45 degrees while one or both armrests 110 are substantially horizontal.

Figure 7:
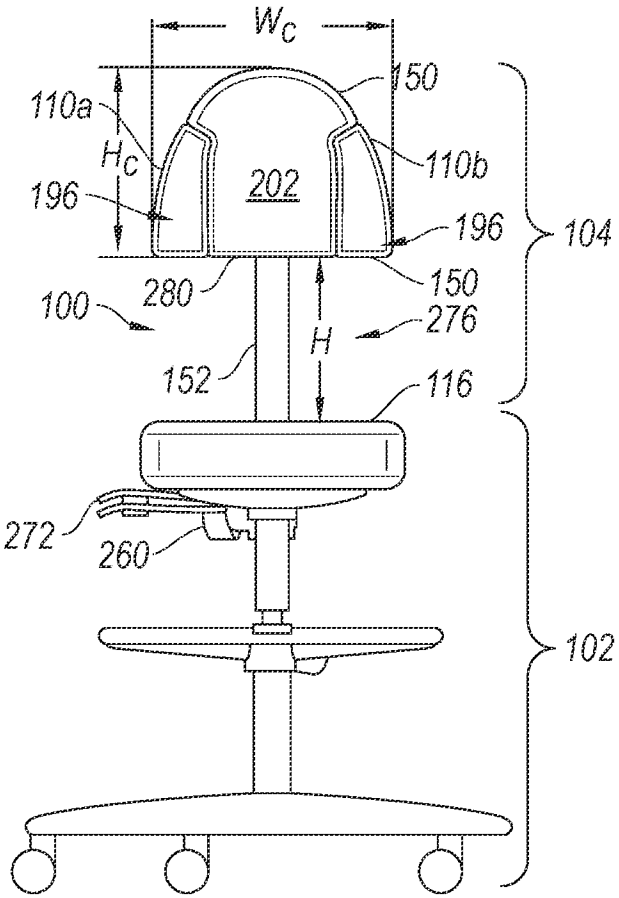
FIGS. 6 and 7 are back views of the stool of FIG. 1.
Figure 6:
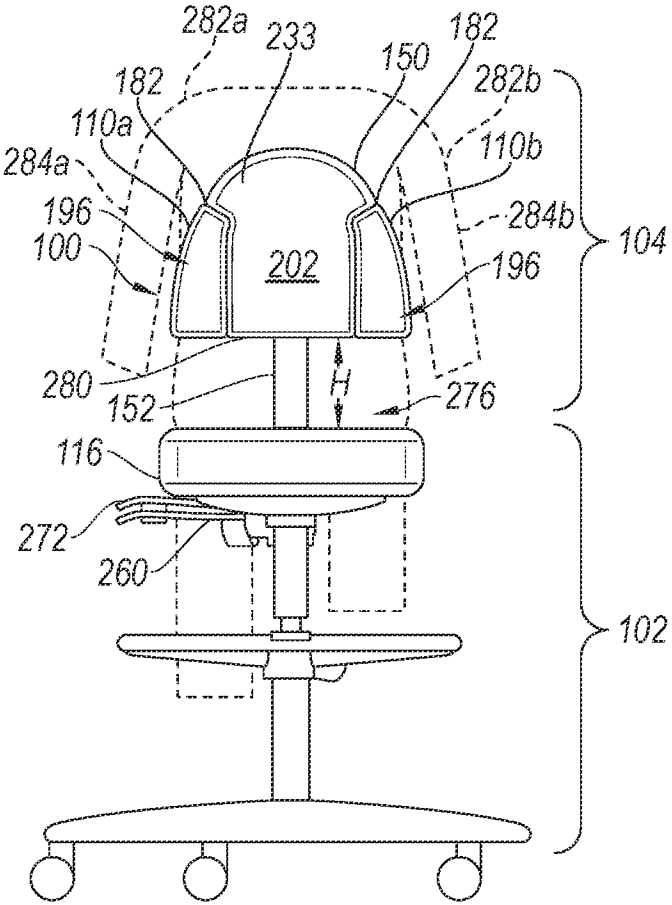

FIG. 6 is a back view of the stool 100 with the chest support 150 at a lowered position. FIG. 7 is a back view of the stool 100 with the chest support 150 at a raised position. The stool 100 can include a vertical adjustment mechanism 260 coupling the elongate member 152 to the seat assembly 102. A user can operate a control element 272 (illustrated as a lever) to switch the adjustment mechanism 260 between a locked state and an unlocked state. In the unlocked state, the adjustment mechanism 260 allows vertical movement of chest support 150 relative to the seat 116 to adjust a height H of a leg-receiving gap 276. In the locked state, the adjustment mechanism 260 can prevent vertical movement of the chest support 150. When the user straddles the elongate member 152, the user's legs can be positioned in the leg-receiving gap 276 and securely held between a bottom 280 of the chest support 150 and the seat 116.

FIG. 6 shows the chest support assembly 104 overlaying a user's torso. Laterally-extending side portions or wings 233 ("side portions 233") of the chest support 150 can extend across most or substantially all the width of the armrest ends 182. In some embodiments, at least about ¼, ½, or ¾ of the width of each armrest 110 is positioned directly underneath respective side portions 233. As shown in FIG. 6, the armrests 110 can be positioned vertically between the side portions 233 and the seat 116. The armrests 110 can be at other positions and have other configurations.

The user's shoulders 282*a*, 282*b* can be spaced apart from the chest support 150 and armrests 110 to permit free movement of the user's arms 284*a*, 284*b*. In some embodiments, the chest support assembly 104 is generally narrower than the width of the user's torso such that the user can move their elbows along their sides without contacting the chest support assembly 104. In some embodiments, a height $H_C$ (FIG. 7) of the chest support 150 can be in a range of about 5 inches (12.7 cm) to about 1 ft. (30.5 cm), about 6 inches (15 cm) to about 14 inches (36 cm), or other suitable heights selected such that the chest support 150 comfortably supports a user's chest. In one embodiment, the height $H_C$ (FIG. 7) is about 11 inches (28 cm), about 11.5 inches (29 cm), or about 1 ft. (30.5 cm). The width We (FIG. 7) of the chest support assembly 104 can be in a range of about 8 inches (20.3 cm) to about 2 ft. (61 cm), about 16 inches (40.6 cm) to about 20 inches (51 cm), about 17 inches (43 cm) to about 19 inches (48 cm). As such, the chest support assembly 104 can be narrower than the user's chest to provide generally unrestricted movement of the user's arms on the front side of the stool 100. In one embodiment, the chest support 150 and armrests 110 are dimensioned to overlay the chest of the user such that most of the surfaces 196, 202 contact the user's chest. The thickness t (FIG. 5) of the chest support 150 and/or armrests 110 can be in a range of about 0.5 inch (1.3 cm) to 2 inches (5 cm). The dimensions of the components of the chest support assembly 104 can be selected based on, for example, the size of the user, desired amount of support, and/or type of activity to be performed. Accordingly, other dimensions can be used, if needed or desired.

Figure 10:
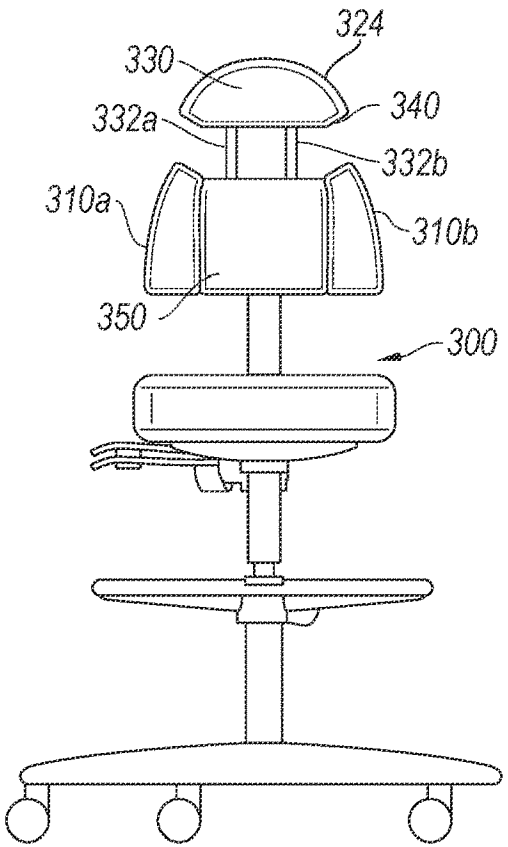
FIG. 10 is a back view of the stool of FIG. 8 with an upper chest support in a raised position.
Figure 9:
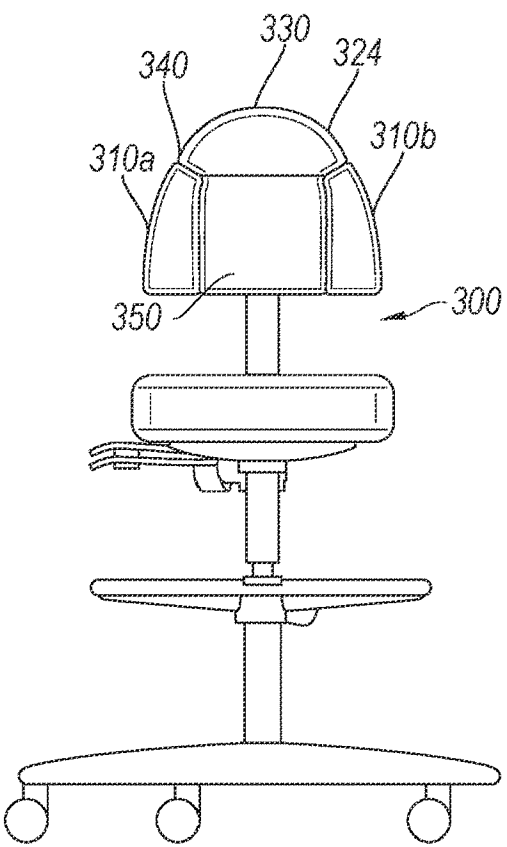
FIG. 9 is a back view of the stool of FIG. 8.
Figure 8:
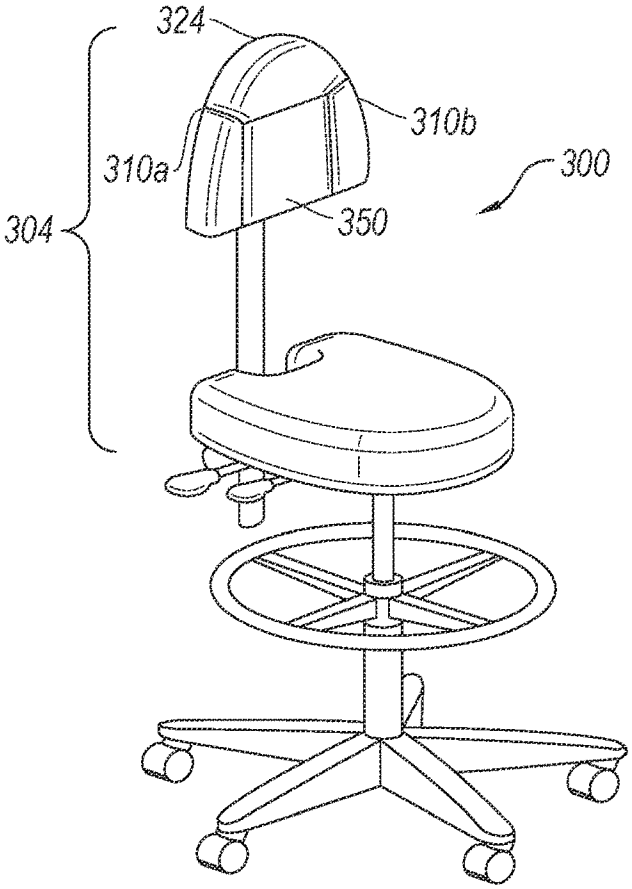
FIG. 8 is an isometric view of a stool with raised armrests in accordance with an embodiment of the present technology.

FIG. 8 is an isometric view of a stool 300 in accordance with an embodiment of the present disclosure. The description of the stool 100 discussed in connection with FIGS. 1 to 7 applies equally to the stool 300, except as detailed below. The stool 300 can include a chest support assembly 304 with armrests 310*a*, 310*b*, a chest support 350, and an upper chest support member 324 ("upper support member 324"). The upper support member 324 is movable between a lowered position (FIGS. 8 and 9) and a raised position (FIG. 10). When the upper support member 324 is in the lowered position, the chest support assembly 304 is in an unexpanded configuration such that the upper support member 324 and the chest support 350 define a generally continuous surface for contacting the user's torso. When the upper support member 324 is in the raised position and spaced apart from the chest support 350, the chest support assembly 304 is in an expanded configuration. The armrests 310 can be raised and lowered independent of the position of the upper support member 324.

Referring now to FIG. 10, the upper support member 324 can include a main body 330 and a pair of rods 332*a*, 332*b* (collectively "rods 332"). The main body 330 can be padded and can include a lower portion 340 configured to mate with the armrests 310*a*, 310*b* and the chest support 350. The chest support 350 can have a generally square shape (shown in FIGS. 9 and 10) or rectangular shape, but it can have other configurations. When the upper support member 324 is in the lowered position (FIG. 9), the rods 332 can be positioned within the chest support 350. A user can lift upwardly on the main body 330 to raise the support member 324 relative to the chest support 350. The rods 332 can extend from the chest support 350 until the upper support member 324 is at the desired height. In some embodiments, a locking mechanism can be used to lock and unlock the upper support member 324. The amount of travel of the upper support member 324 can be in a range of about 2 inches (5 cm) to about 6 inches (15 cm), about 2 inches (5 cm) to about 5 inches (12.7 cm), or about 2 inches (5 cm) to about 4 inches (10 cm). In certain embodiments, the upper support member 324 can be separated from the chest support 350 by distance equal to or greater than about 1 inch (2.5 cm), 2 inches (5 cm), 3 inches (7.6 cm), 4 inches (10 cm), or 5 inches (12.7 cm) when in the fully deployed position.

Figure 11:
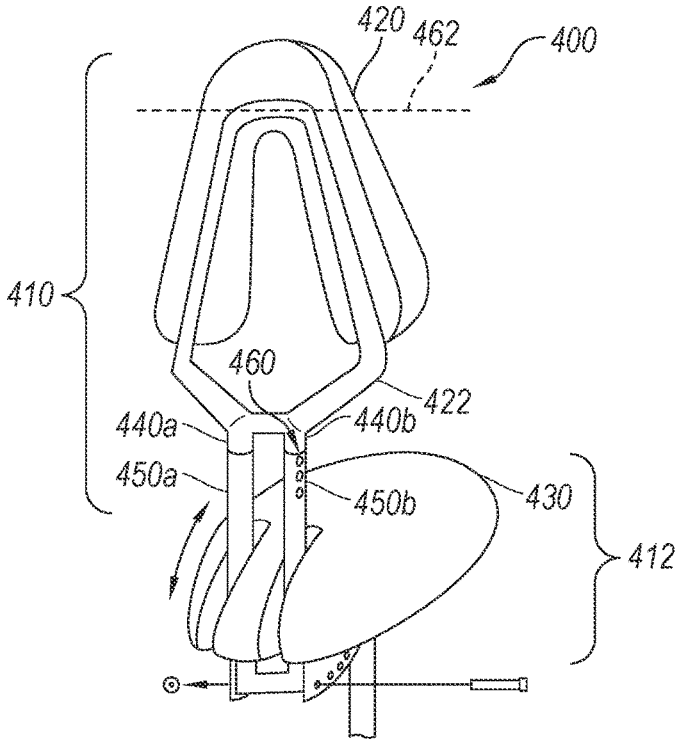
FIG. 11 is an isometric view of a chest support assembly in accordance with an embodiment of the present technology.

FIG. 11 is an isometric view of a portion of a stool 400 in accordance with an embodiment of the present technology. The stool 400 can include a chest support assembly 410 and a seat assembly 412. The chest support assembly 410 can include a chest support 420 and a frame 422, which couples the chest support 420 to a seat 430. The chest support 420 can have an upside down V-shape or U-shape. The frame 422 can be fixedly coupled to the chest support 420 by, for example, one or more brackets, fasteners (e.g., screws, nut and bolt assembles, etc.), or the like. The frame 422 can include rods 440*a*, 440*b* (collectively "rods 440") slidably received by receivers 450*a*, 450*b*, respectively, of the seat assembly 412. One or more pins can be removed from holes 460 to vertically move the frame 422, and the pins can be inserted in the holes 460 to lock the chest support assembly 410 to the seat assembly 412.

Figure 12:
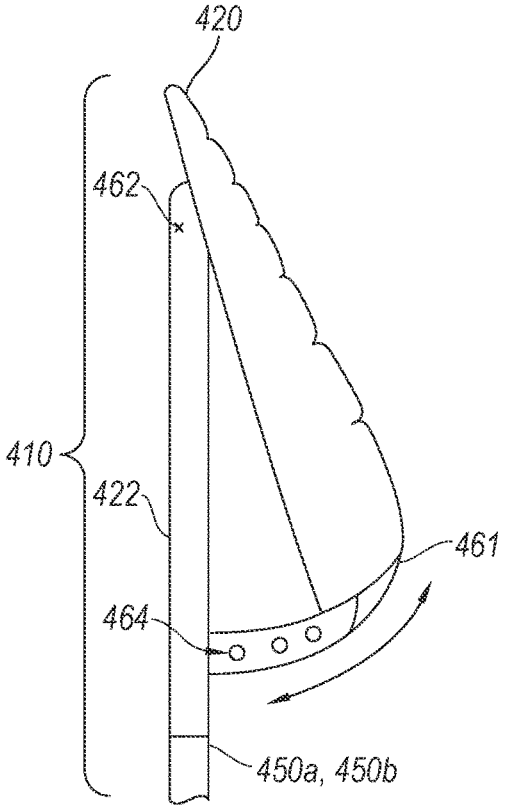
FIG. 12 is a side view of the chest support assembly of FIG. 11 with a tilted chest support.

FIG. 12 is a side view of the chest support assembly 410 of FIG. 11. A hinge (not shown in FIG. 12) can rotatably couple the chest support 420 to the frame 422. A tilt mechanism 461 can be unlocked by removing a pin, and the chest support 420 can be rotated about an axis of rotation 462. The pin can be inserted into one of the holes 464 to lock the chest support 420 at the desired angle of inclination. Other types of mechanisms (e.g., tilt mechanisms, pivot mechanisms, etc.) can be utilized.

Figure 13:
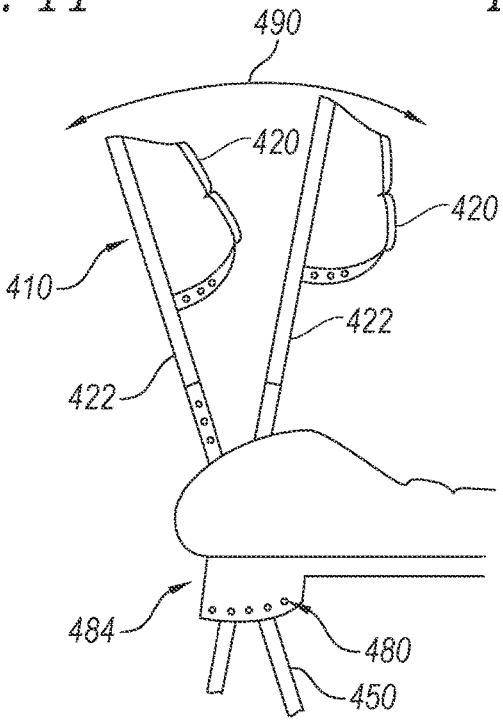
FIG. 13 is a side view of the chest support assembly of FIG. 11 in different positions.

FIG. 13 is a side view of a tilt mechanism 484 for tilting the chest support assembly 410. A pin can be removed from one of the holes 480 to rotate the frame 422, as indicated by arrow 490. When the chest support 420 (shown at two different positions) is at the desired orientation, the pin can be inserted through the appropriate hole 480 to lock the chest support assembly 410.

To perform a task at relative low locations (e.g., to tattoo a lower body part, such as a client's leg when the client is sitting in a chair), the chest support 420 can be tilted forward. Once the chest support 420 is at the desired orientation, the tilt mechanism 481 can be locked. The user can straddle the chest support assembly 410 and can comfortably lean on the chest support 420 for a relatively long period time to perform the task. Although not shown in FIGS. 11-13, armrests can be incorporated into the chest support assembly 410. For example, armrests can be rotatably coupled to the sides of the chest support 420.

Figure 14:
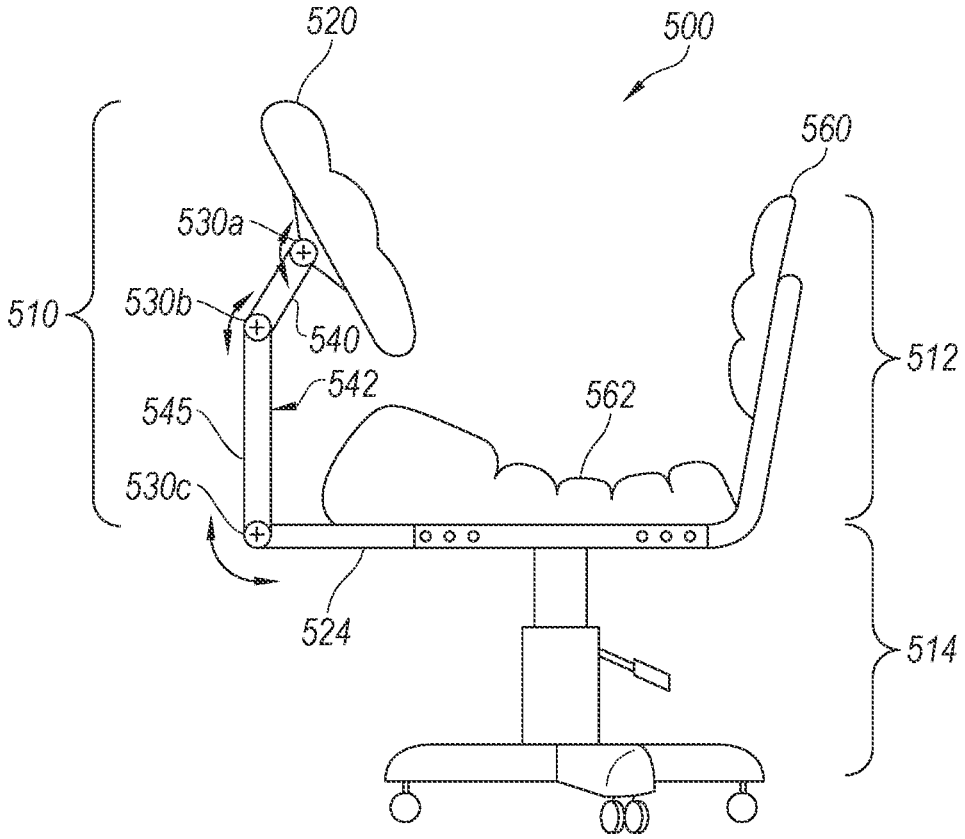
FIG. 14 is a side view of a chair in accordance with an embodiment of the present technology.

FIG. 14 is a side view of a chair 500 in accordance with an embodiment of the present technology. The chair 500 can include a chest support assembly 510, a back support assembly 512, and a seat assembly 514. The chest support assembly 510 can include a chest support 520 and a connector apparatus 542. In some embodiments, including the illustrated embodiment, the connector apparatus 542 includes members 540, 545 and pivots 530*a*, 530*b*, 530*c*. The elongated member 540 can extend between the pivots 530*a*, 530*b*. The elongated member 545 can extend between the pivots 530*b*, 530*c*. The back support assembly 512 can include a back support 560 for supporting the user's back. The user can sit on a seat 562 and either lean rearward against the back 560 or lean forward against the chest support 520.

Figure 15:
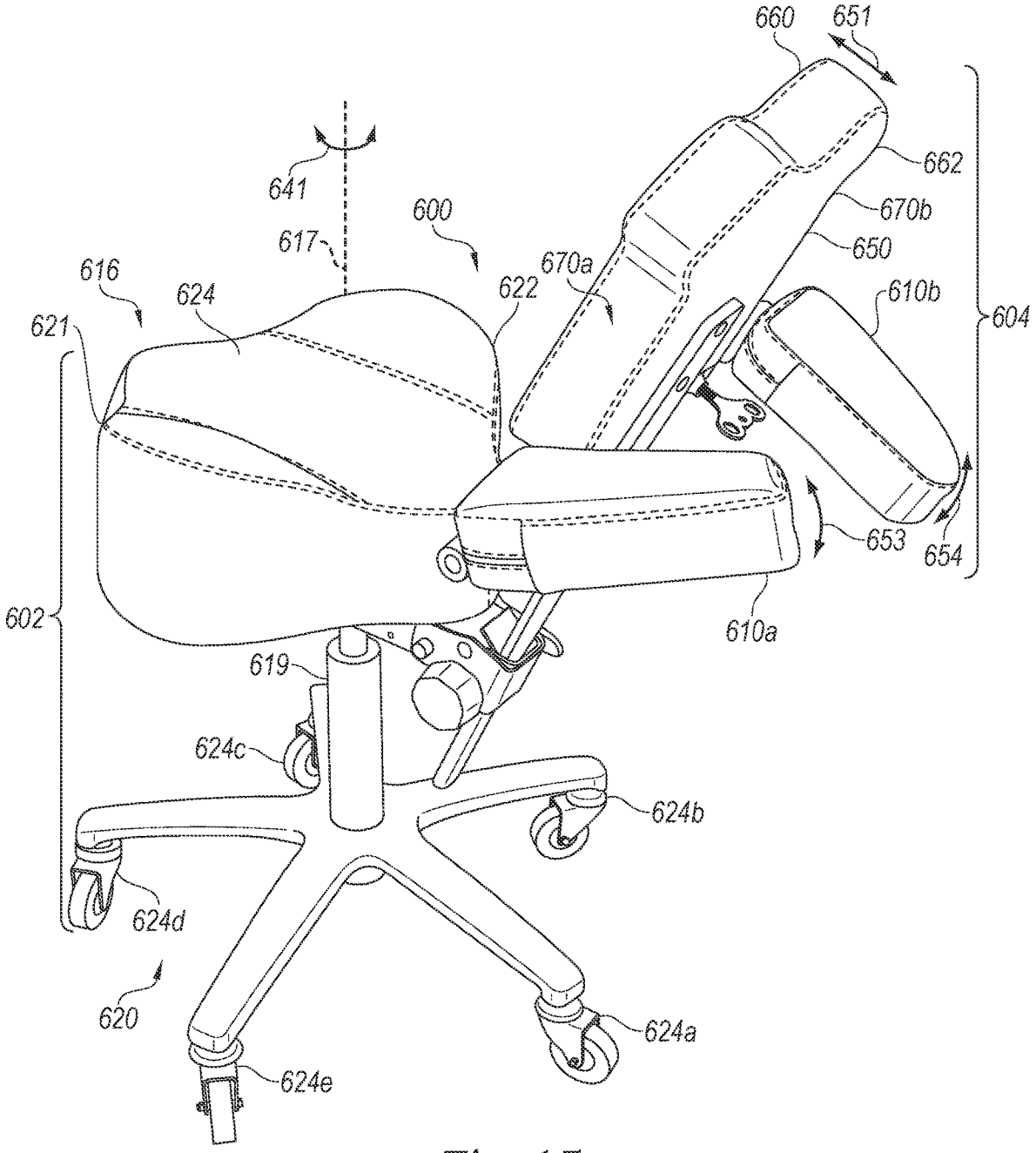
FIG. 15 is an isometric view of a stool with a tilted chest support, an inclined right armrest, and a declined left armrest in accordance with an embodiment of the present technology.

FIG. 15 is an isometric view of a stool 600 in accordance with an embodiment of the present technology. The stool 600 can include a seat assembly 602 and a chest support assembly 604. When a user sits on the seat assembly 602, the user's chest can rest comfortably against the chest support assembly 604 such that the user's arms are free to move in front of the stool 600. Armrests 610*a*, 610*b* can be moved between preset positions to ergonomically support the user's arms and, in some embodiments, can be removed from a chest support 650. The chest support 650 can be rotated (indicated by arrow 651) and the armrests 610*a*, 610*b* (collectively "armrests 610") can be rotated (indicated by arrows 653, 654) to provide a large number of ergonomic configurations. The illustrated chest support 650 and right armrest 610*a* are at inclined orientations, and the left armrest 610*b* is at a declined orientation.

The seat assembly 602 can include a contoured seat 616 and a base assembly 620 carrying the seat 616. The seat 616 has flared or sloped regions 621, 622 and a central region 624. The regions 621, 622 can be sufficiently sloped or angled to help keep the user generally centered on the central region 624. The base assembly 620 can include a base member 619 and wheels 624*a*, 624*b*, 624*c*, 624*d*, 624*e* (collectively "wheels 624"). The base member 619 can include a hydraulic assembly that can raise and lower the seat 616, which can rotate (indicated by arrow 641) about a vertical axis of rotation 617. The chest support 650 has a backside 660 for supporting an occupant, a front side 662 facing away from the occupant, and armrest-receiving portions 670*a*, 670*b* having complementary shapes with the armrests 610*a*, 610*b*, respectively.

Figure 16:
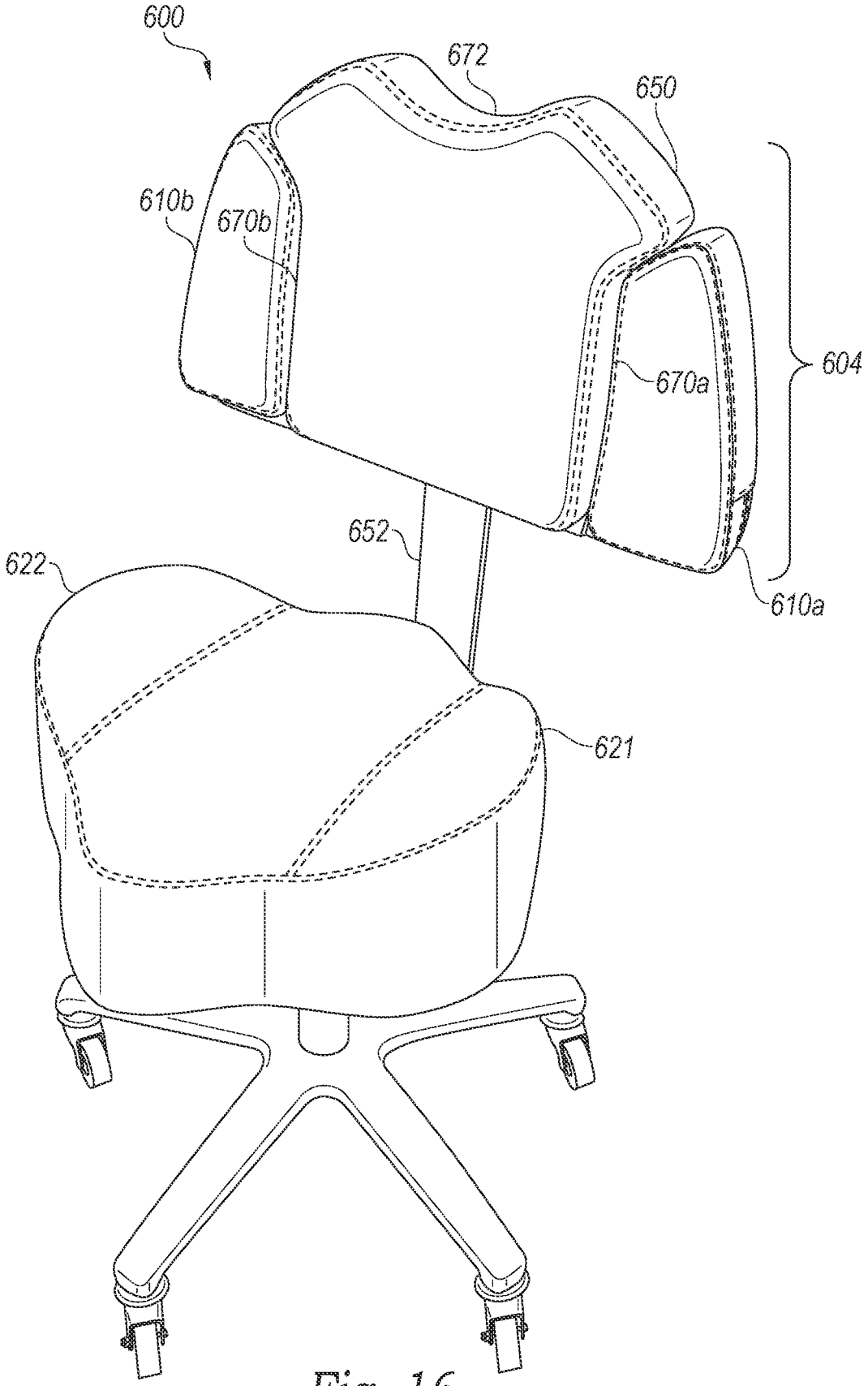
FIG. 16 is an isometric view of the stool with stowed armrests.
Figure 17:
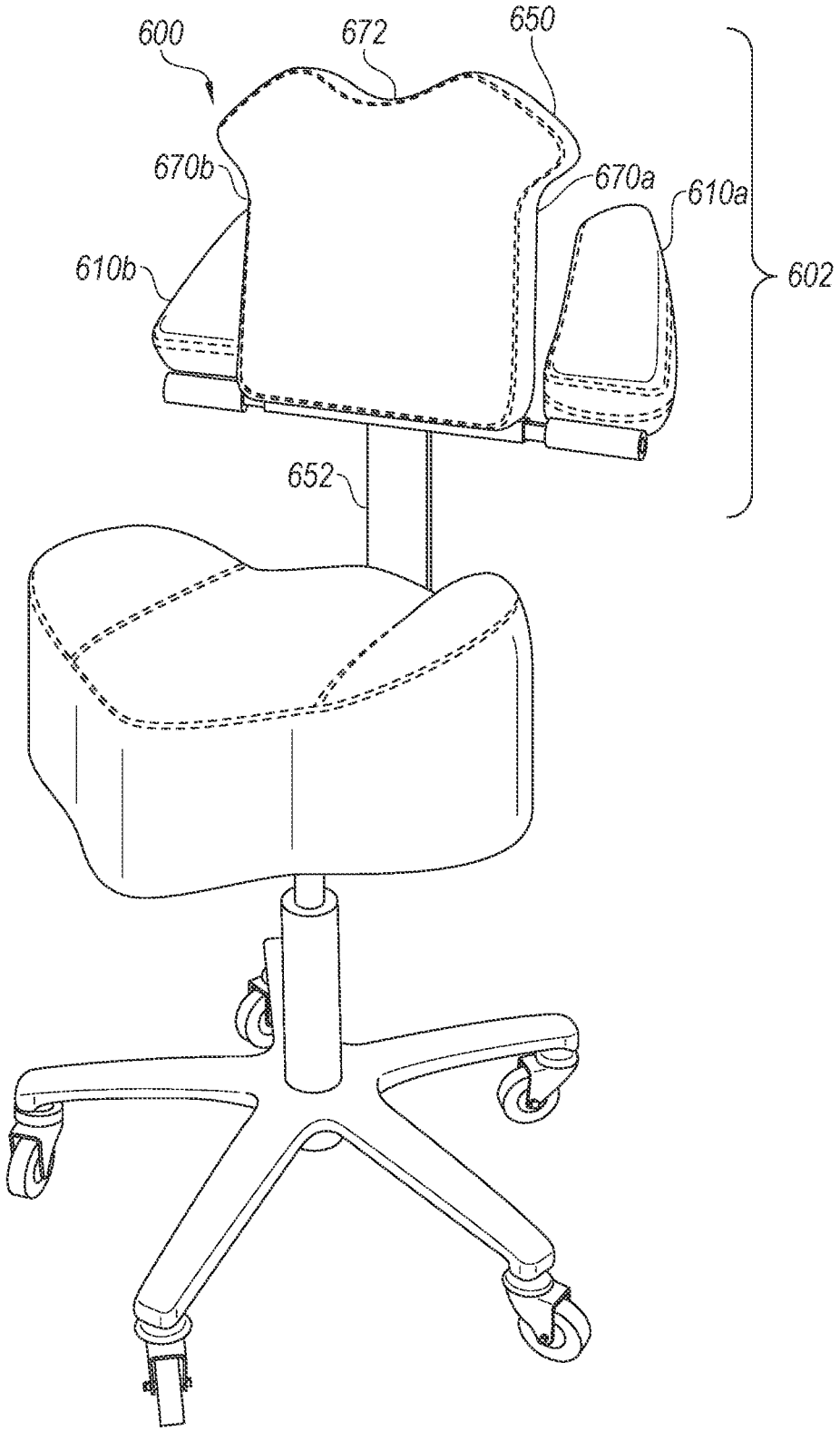
FIG. 17 is an isometric view of the stool with partially lowered armrests.

FIG. 16 is an isometric view of the stool 600 with stowed armrests 610, and FIG. 17 is an isometric view of the stool 600 with lowered armrests 610. Referring now to FIG. 16, the stowed armrests 610*a*, 610*b* are located in the armrest-receiving portions 670*a*, 670*b*, respectively, such that when a user straddles an elongate member 652 of the chest support assembly 604, the sloped seat regions 621, 622 can inhibit lateral movement of the user to help keep the user's torso centered relative to the chest support 650. The chest support 650 can have a contoured upper portion 672 that is complementary (e.g., shaped to receive) with a portion of the user's body. In some embodiments, the upper portion 672 can be a concaved or recessed region with a U-shaped profile, a V-shaped profile, or other shaped profile for matching the user's body, such as the user's neck and/or chin.

Figure 18:
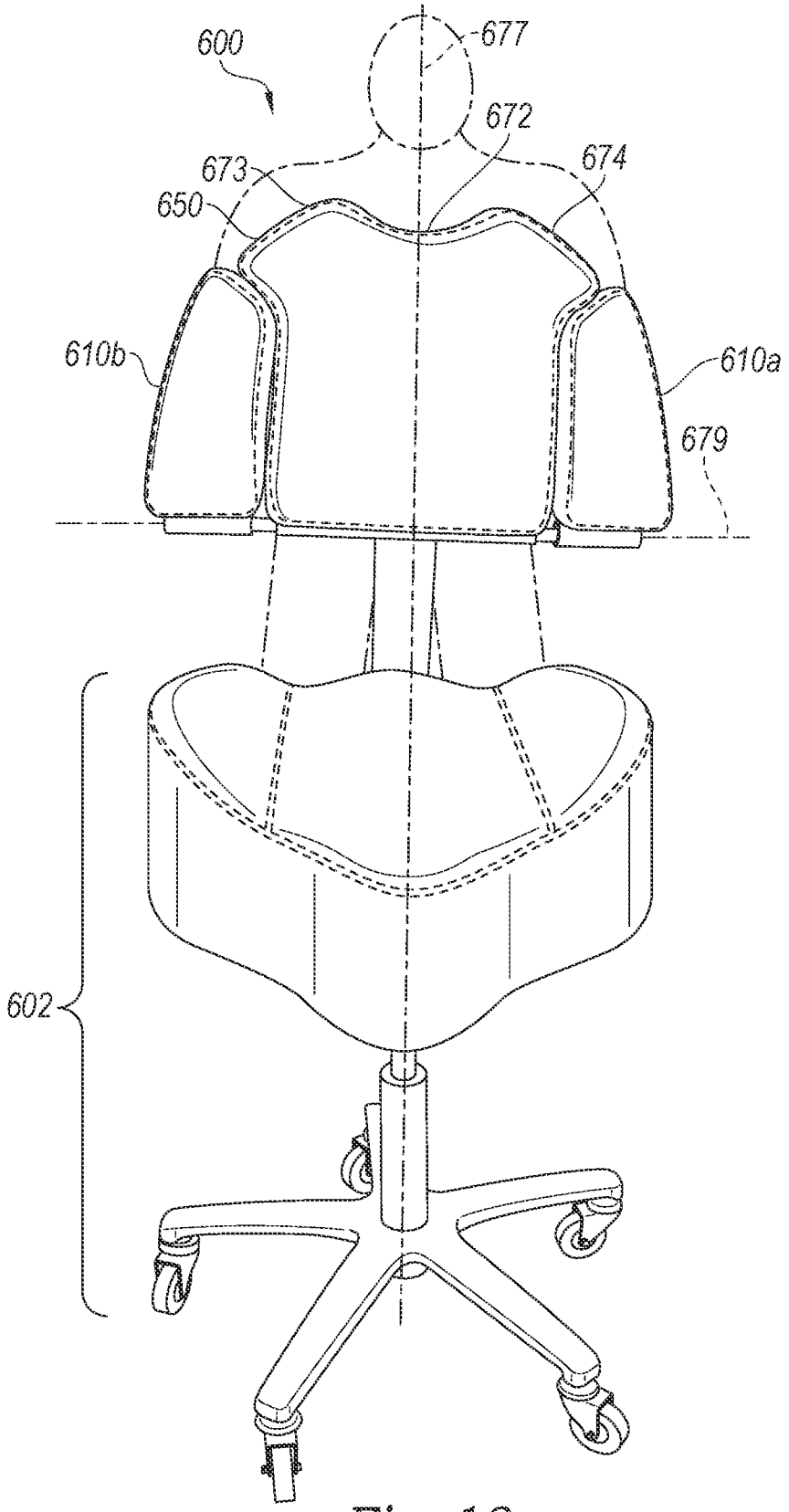
FIG. 18 is a back view of the stool with stowed armrests and a user sitting on the stool.

FIG. 18 shows a user (illustrated in dashed line) sitting on the seat 616. The user's chin is positioned generally above the contoured upper portion 672 positioned centrally along the chest support 650 to provide a relatively large amount of unrestricted movement of the user's head. The shoulder regions or wings 673, 674 can extend laterally outward from the upper portion 672 and can support the user's shoulders when the user leans forward. The armrests 610*a*, 610*b* can be moved away from a center plane 677 of the stool 600 to unlock the armrests such that the armrests are freely rotatable about an axis of rotation 679. Locking/unlocking the armrests 610 is discussed in connection with FIGS. 24 and 25.

Figure 19:
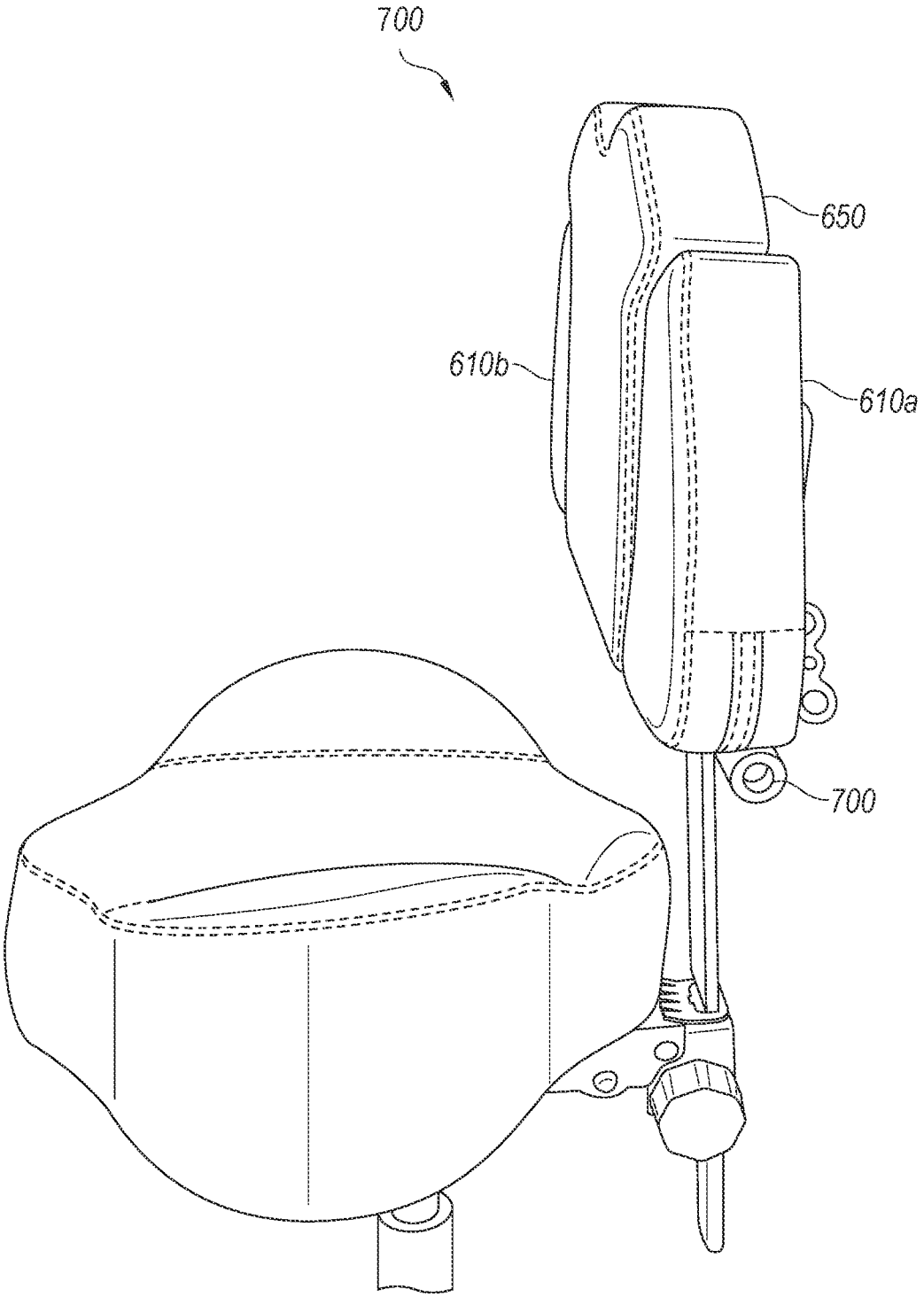
FIGS. 19-23 are side views of the stool with armrests in different positions.
Figure 20:
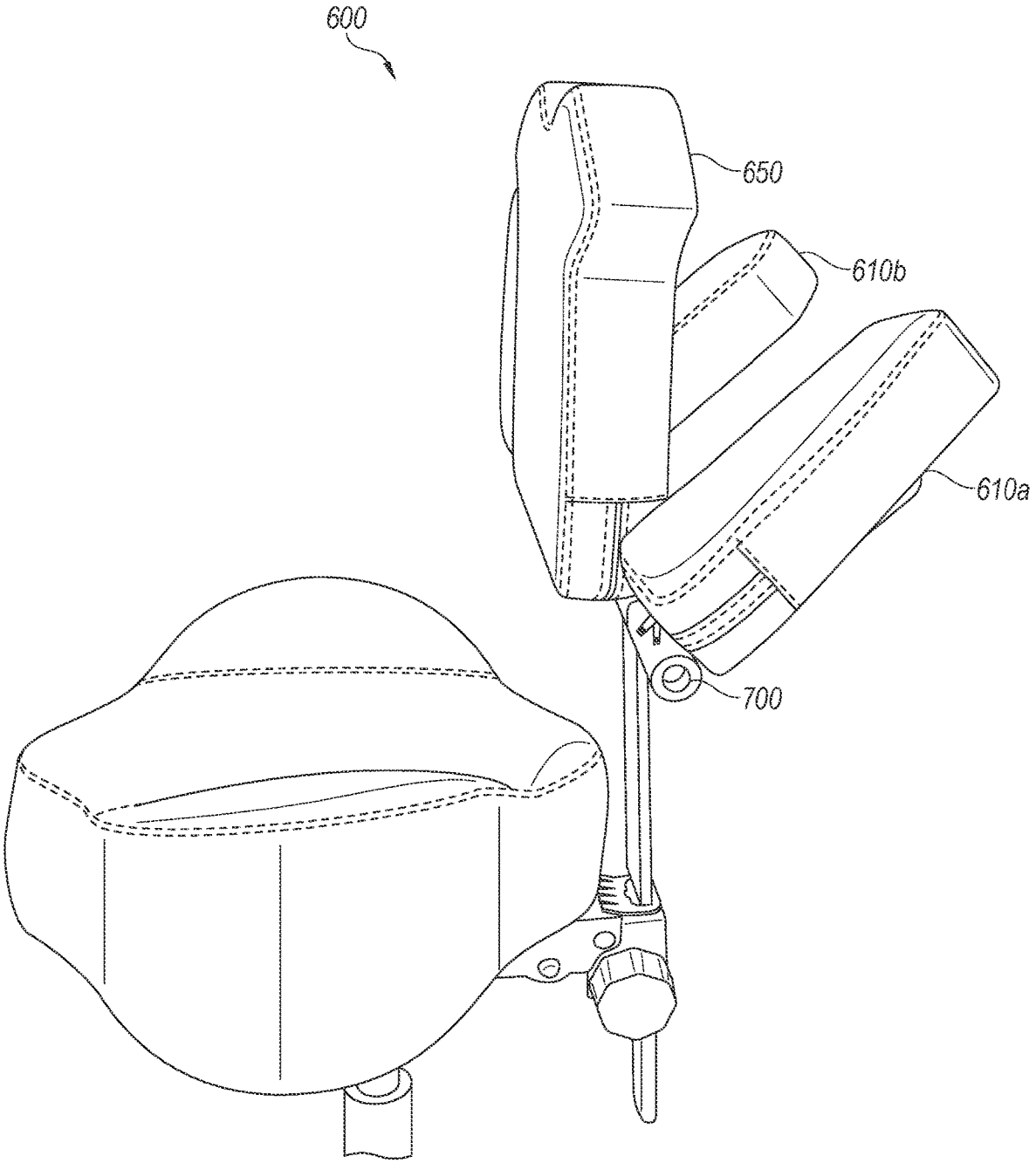
Figure 21:
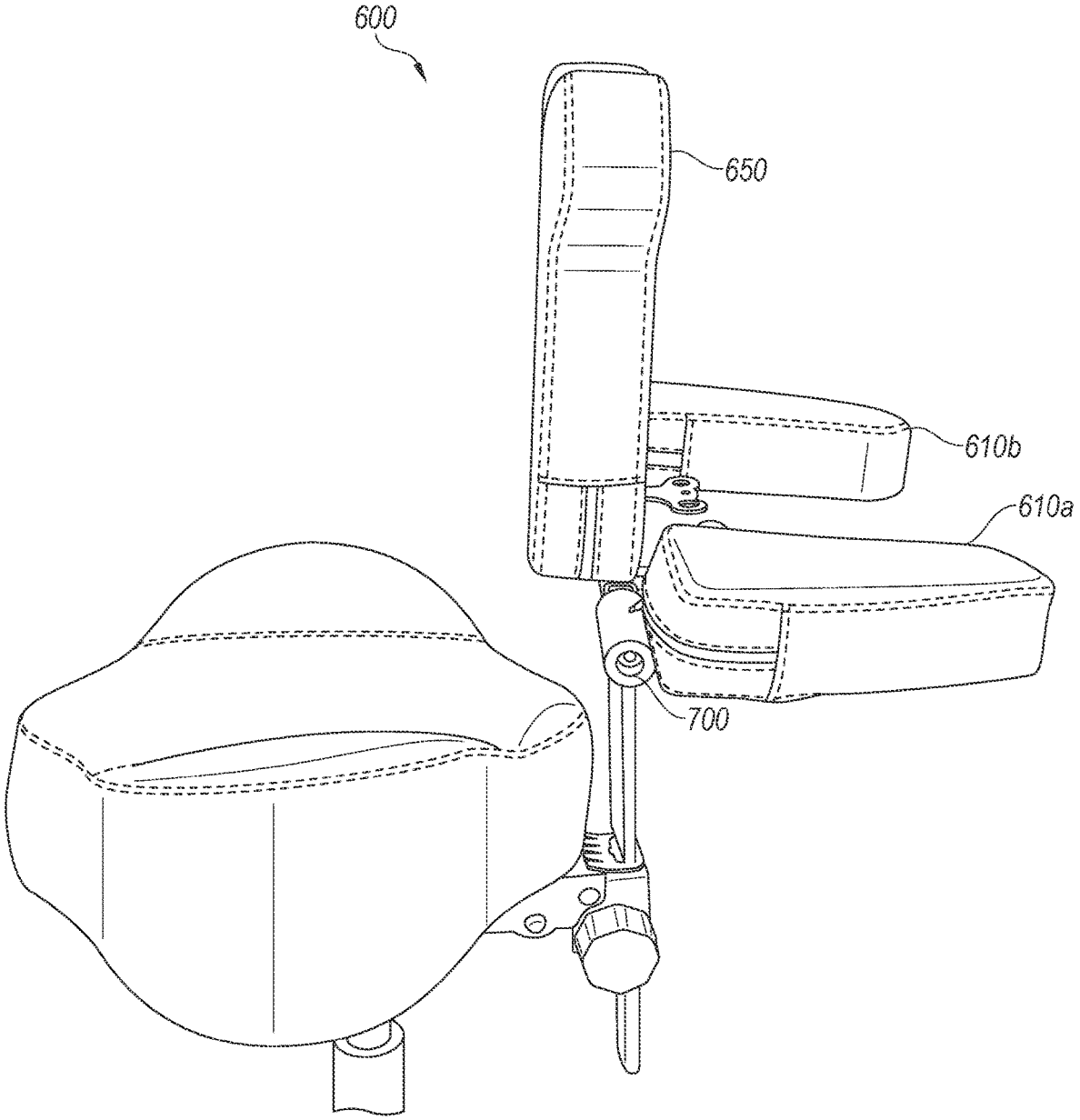
Figure 22:
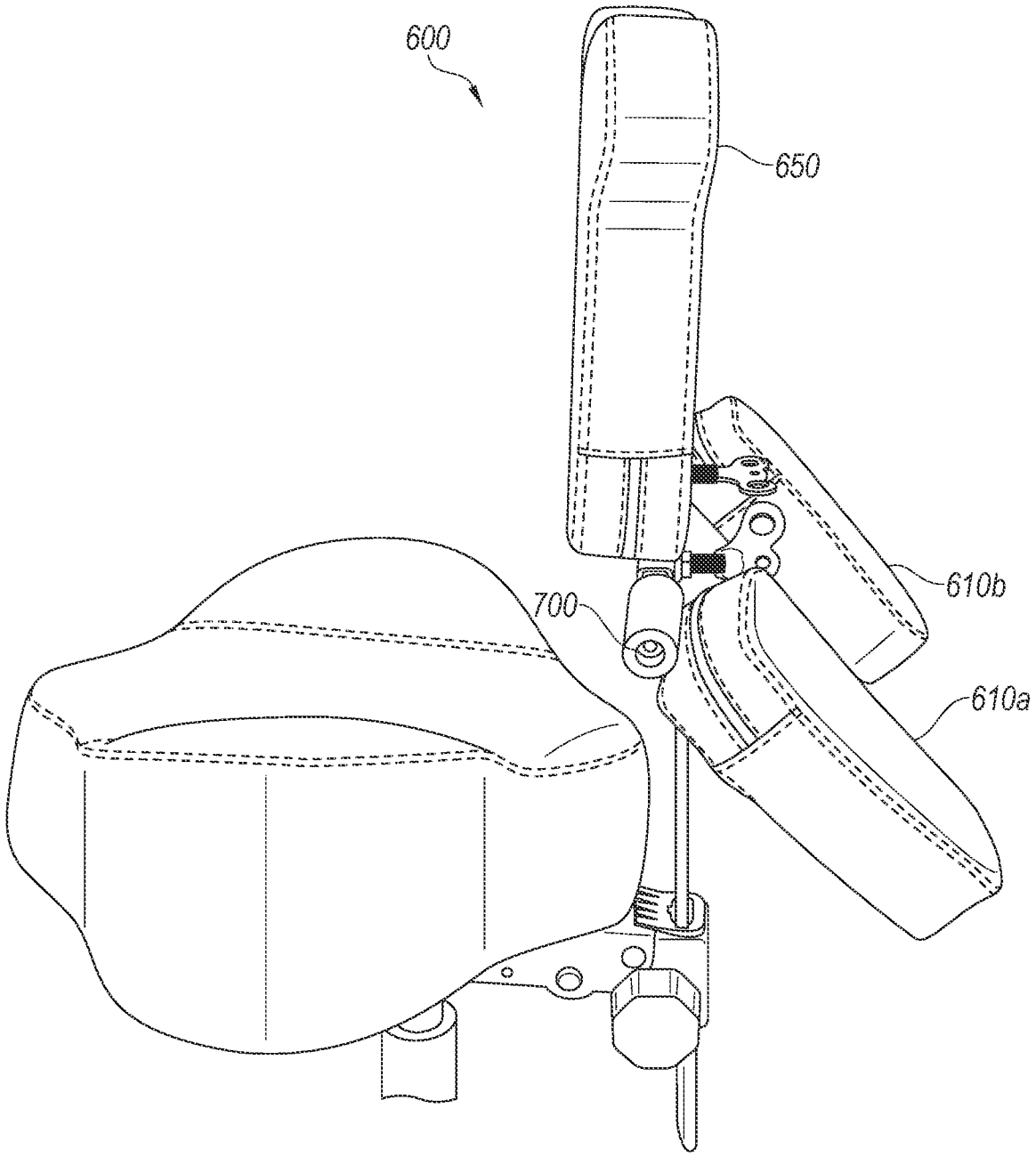
Figure 23:
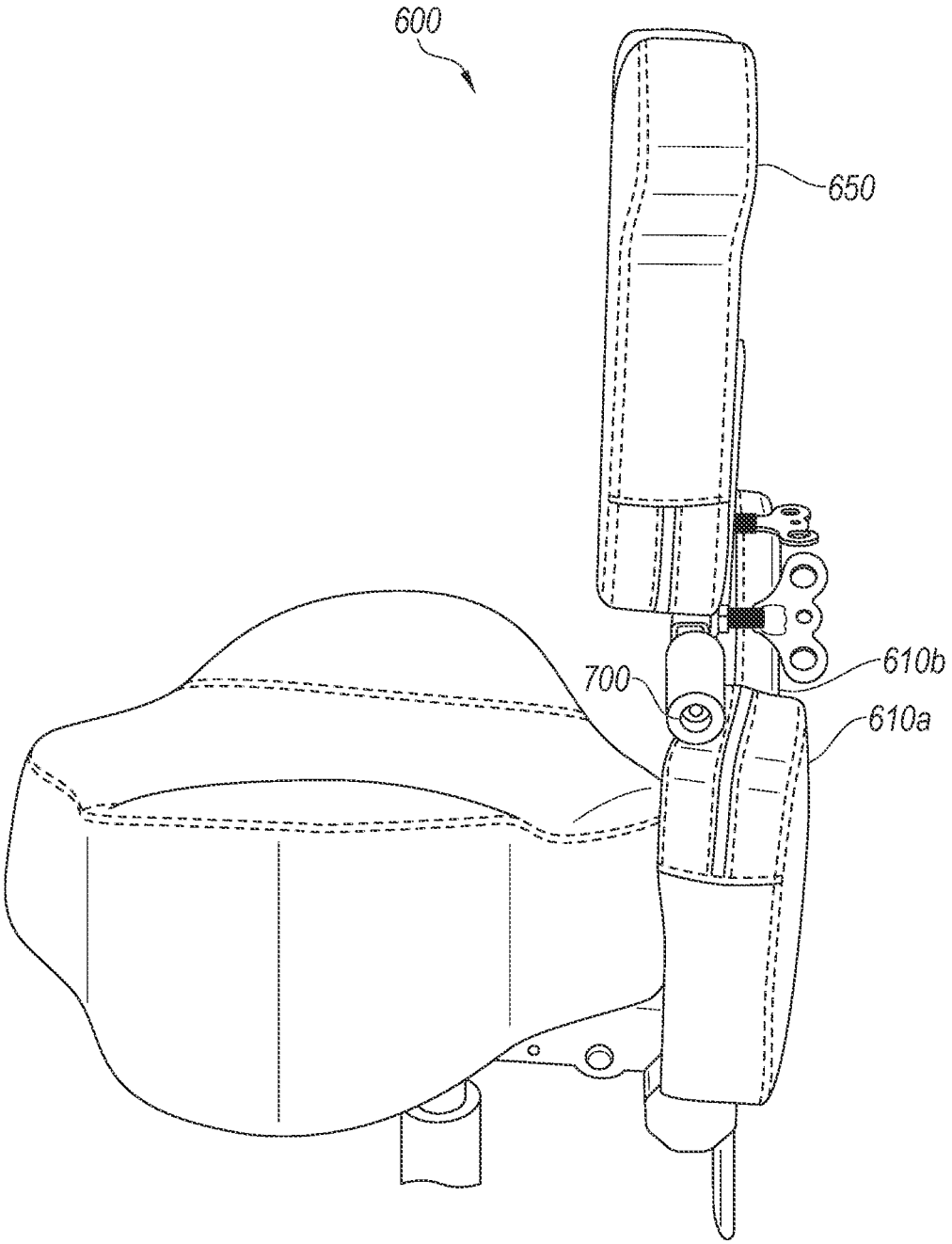

FIGS. 19-23 show the armrests 610 at different angular positions. In particular, FIG. 19 shows the armrests 610 at stowed positions. FIG. 20 shows the armrests 610 at inclined orientations. FIG. 21 shows the armrests 610 at generally horizontal orientations. FIG. 22 shows the armrests 610 at declined orientations. FIG. 23 shows the armrests 610 in fully lowered positions in which the armrests 610 extend in a direction that is generally parallel to a plane of the chest support 650. The lowered armrests 610 of FIG. 23 can help support a user's lower back or buttock when the user's back is against the chest support 650 serving as a back support. The number of angular positions of the armrests 610*a*, 610*b* can be selected based on the use of the stool 600 and can be, for example, 2 to 25 preset positions, 5 to 20 preset positions, etc. In some embodiments, an armrest positioner assembly 700 (FIG. 23) can allow the armrests 610 to be moved between about 15 preset angular positions and can include one or more pivoting mechanisms, release mechanisms, hinges, bearings, pins, or combinations thereof. One embodiment of the armrest positioner assembly 700 is discussed in connection with FIGS. 24 and 25.

Figure 24:
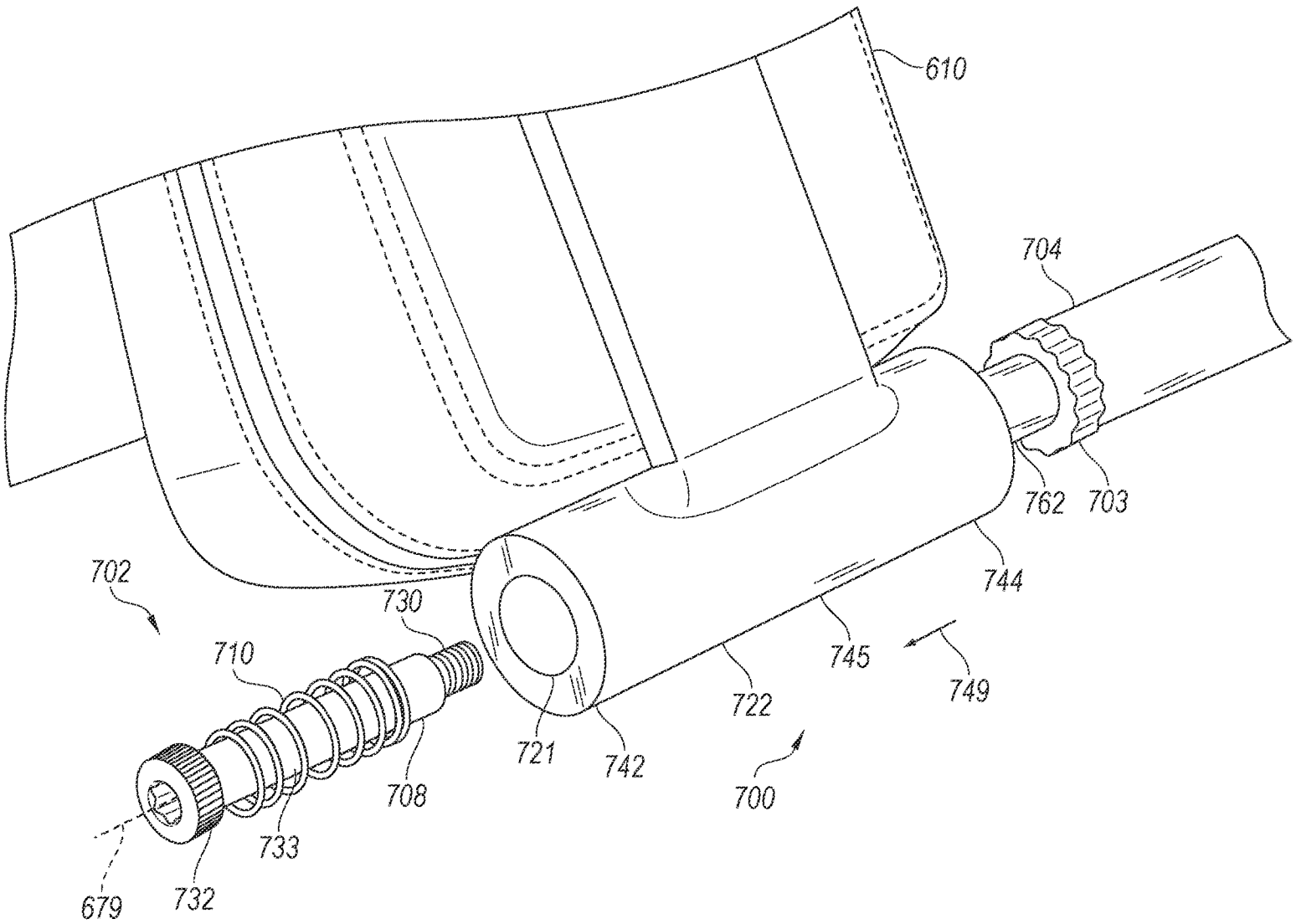
FIG. 24 is an exploded isometric view of components of an armrest positioner assembly in accordance with an embodiment of the present technology.

FIG. 24 is an exploded isometric view of the armrest positioner assembly 700 including a biasing assembly 702 and a rod 704. The biasing assembly 702 can bias the armrest 610 toward a locked state and can include a fastener 708 and a biasing member 710 surrounding the fastener 708. The fastener 708 has an externally threaded end 730 for coupling to the rod 704, a head 732 for contacting the biasing member 710, and a main body 733. The fastener 708 can be located in a passageway 721 of a receiver 722 such that the biasing member 710 is compressed between a stop or a shoulder inside the receiver 722 and the fastener head 732. The biasing member 710 can include one or more springs (e.g., helical springs, compression springs, etc.) that can urge the receiver 722 towards engagement features 703 of the rod 704.

Figure 25:
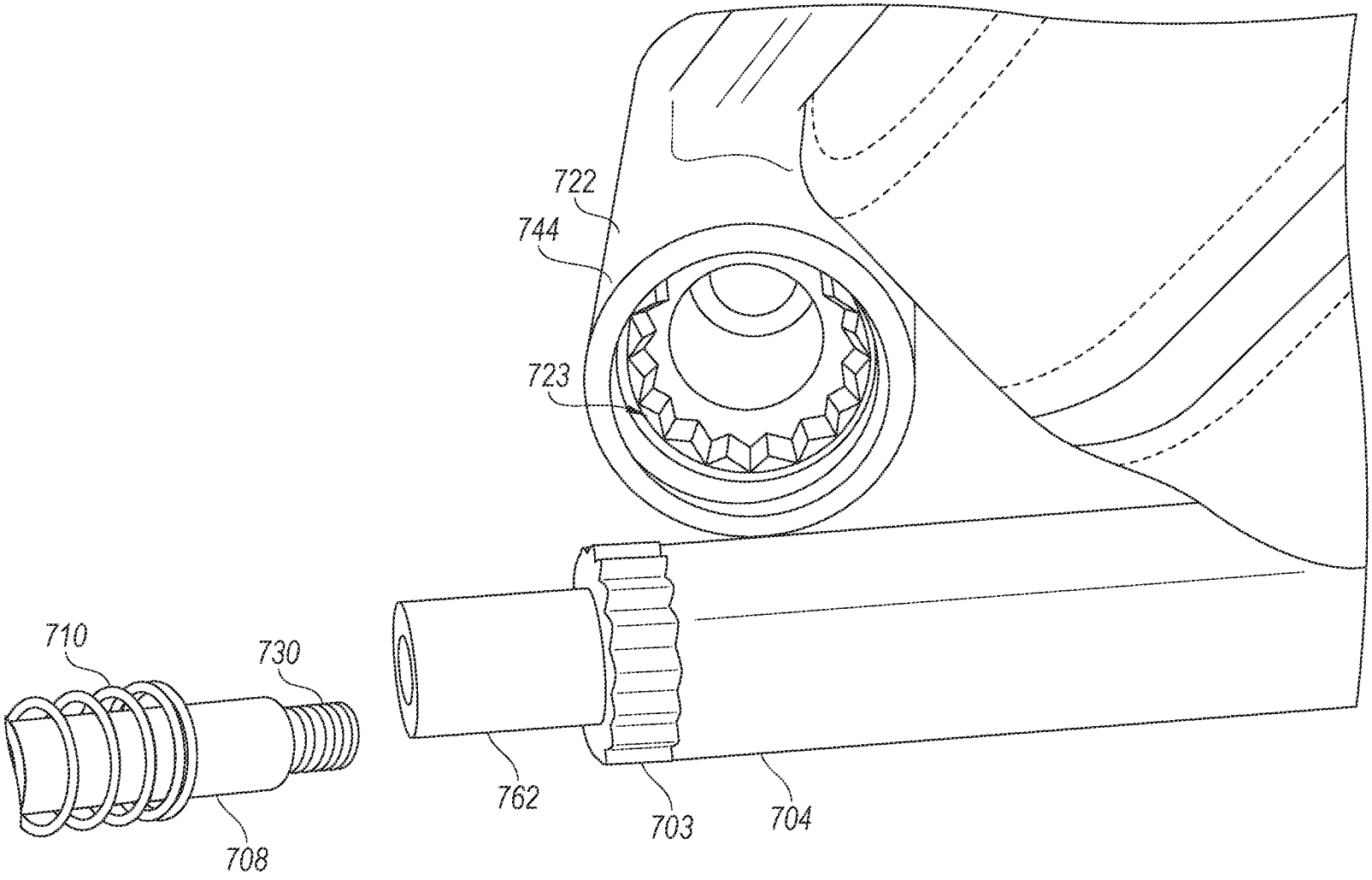
FIG. 25 shows components of the armrest positioner assembly.

The receiver 722 can be a hollow member (e.g., a tubular member) or holder fixed to the armrest 610 and can have ends 742, 744 and a main body 745. The end 742 is configured to receive the head 732 of the fastener 708, and the end 744 is configured to receive a pin 762 threadably coupleable to the threaded end 730. FIG. 25 shows the receiver end 744 with engagement features in the form of teeth 723 for engaging engagement features 703 in the form of teeth. In a locked state, the teeth 723 can mesh with the teeth 703 to rotationally fix the armrest 610 relative to the chest support. When a user manually moves the receiver 722 away from the teeth 703 (indicated by arrow 749 in FIG. 24) by overcoming the biasing of the biasing member 710, the teeth 723 (FIG. 25) can disengage and move away from the teeth 703. The armrest 610 can then freely rotate about the axis of rotation 679 (FIGS. 18 and 24) defined by the fastener 708 and pin 762. Once the armrest 610 is at a desired position, the user can allow the biasing member 710 to urge the armrest 610 back to the rotationally locked state in which the teeth 723 engage the teeth 703. The number and size of the teeth can be selected based on the desired number of preset angular positions (e.g., 2-20 positions, 5-17 positions, 6-15 positions, 15 positions, etc.) of the armrest 610.

Figure 26:
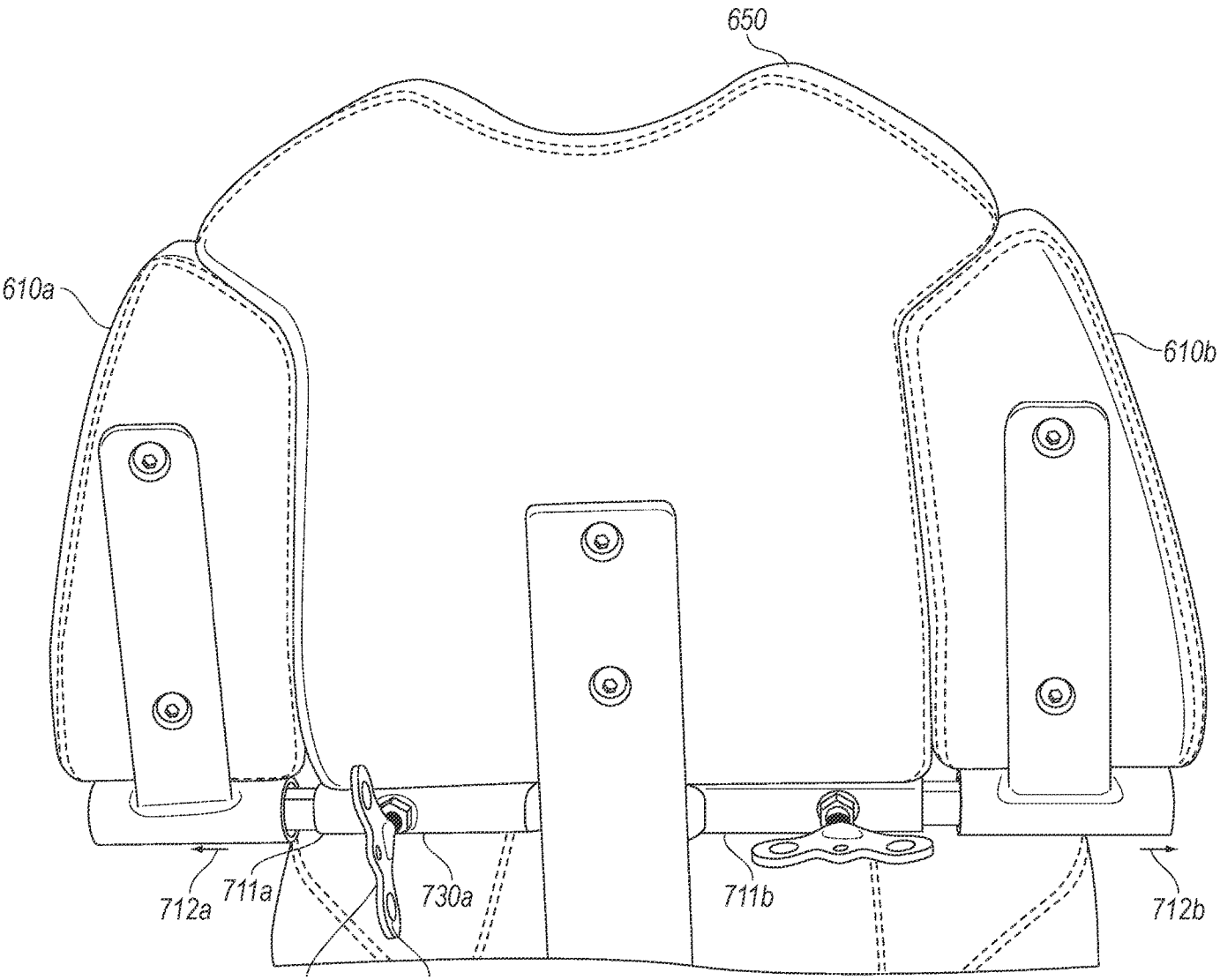
FIG. 26 is a front view of a chest support with stowed armrests in laterally undeployed positions.
Figure 27:
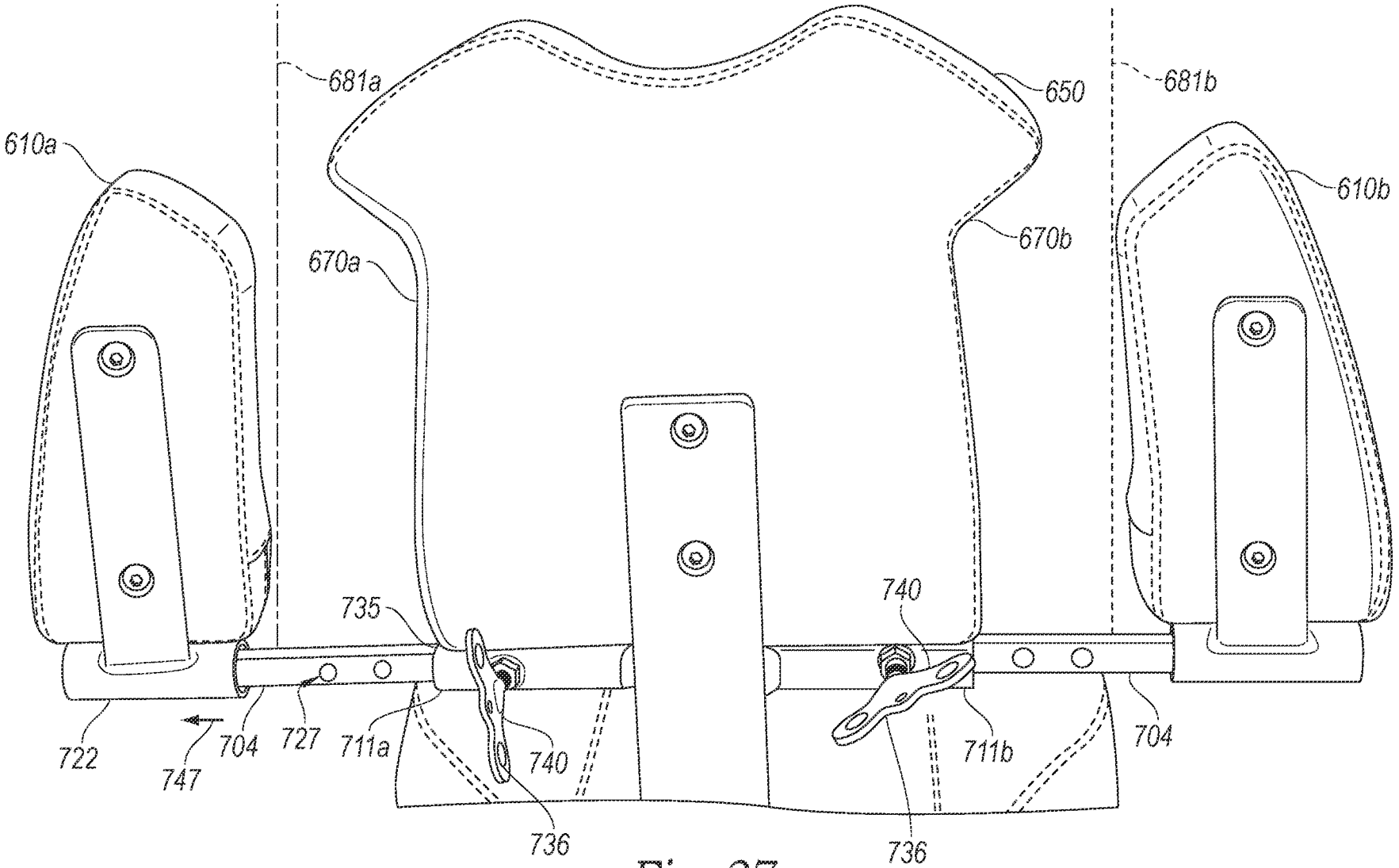
FIG. 27 is a front view of the chest support with armrests in laterally deployed positions.

FIGS. 26 and 27 are front views of the chest support 650 with extension mechanisms 711*a*, 711*b* having locked configurations for laterally locking the respective armrests 610*a*, 610*b* and deployed configurations for allowing lateral movement of the respective armrests 610*a*, 610*b*. FIG. 26 shows the armrests 610 at laterally undeployed positions. The armrests 210 can be moved laterally outward (indicated by arrows 712*a*, 712*b* in FIG. 26) to laterally deployed positions shown in FIG. 27.

Referring now to FIG. 27, the extension mechanisms 711*a*, 711*b* can be generally similar to each other, and accordingly, the description of one extension mechanism 711*a*, 711*b* applies equally to the other extension mechanism 711*a*, 711*b* unless indicated otherwise. The extension mechanism 711*a* can include the rod 704, a receiver 735 (e.g., a hollow tube) that receives the rod 704, and a locking device 736. The rod 704 can include an array of receiving-features 727 (e.g., holes) for receiving the locking device 736, which can include one or more pins, handles, or other features for locking/unlocking the rod 704. In one embodiment, the locking device 736 includes a handle 740 that can be rotated to move a pin of the locking device 736 into and out of the holes 727. When the locking device 736 is in an unlocked state, the rod 704 can be extended from the receiver 735 (indicated by arrow 747). The locking device 736 can be rotated to move a pin into one of the holes 727 when the armrest 610*a* is positioned at the desired lateral position. The extension mechanisms 711*a*, 711*b* can be used to increase or decrease the spacing between the armrests 610*a*, 610*b* based on, for example, the width of the user's shoulders, the desired spacing between the user's forearms, or other criteria. In some embodiments, the armrests 610*a*, 610*b* can be moved away from the chest support 650 a distance equal to or longer than about 1 inch (2.5 cm), about 2 inches (5 cm), about 3 inches (7.6 cm), about 4 inches (10 cm), or about 5 inches (12.7 cm). In one embodiment, each armrest 610*a*, 610*b* can be moved about 2.5 inches (6.4 cm) away from the chest support 650 to be moved to the fully deployed position.

As shown in FIG. 27, when the armrests 610*a*, 610*b* are in the fully laterally deployed positions, the armrest 610*a* and the chest support 650 can be positioned on opposite sides of an imaginary vertical plane 681*a*. The armrest 610*b* and the chest support 650 can be positioned on opposite sides of an imaginary vertical plane 681*b*. Accordingly, the armrests 610*a*, 610*b* can be positioned completely outside of the armrest-receiving portions 670*a*, 670*b*.

Figure 28:
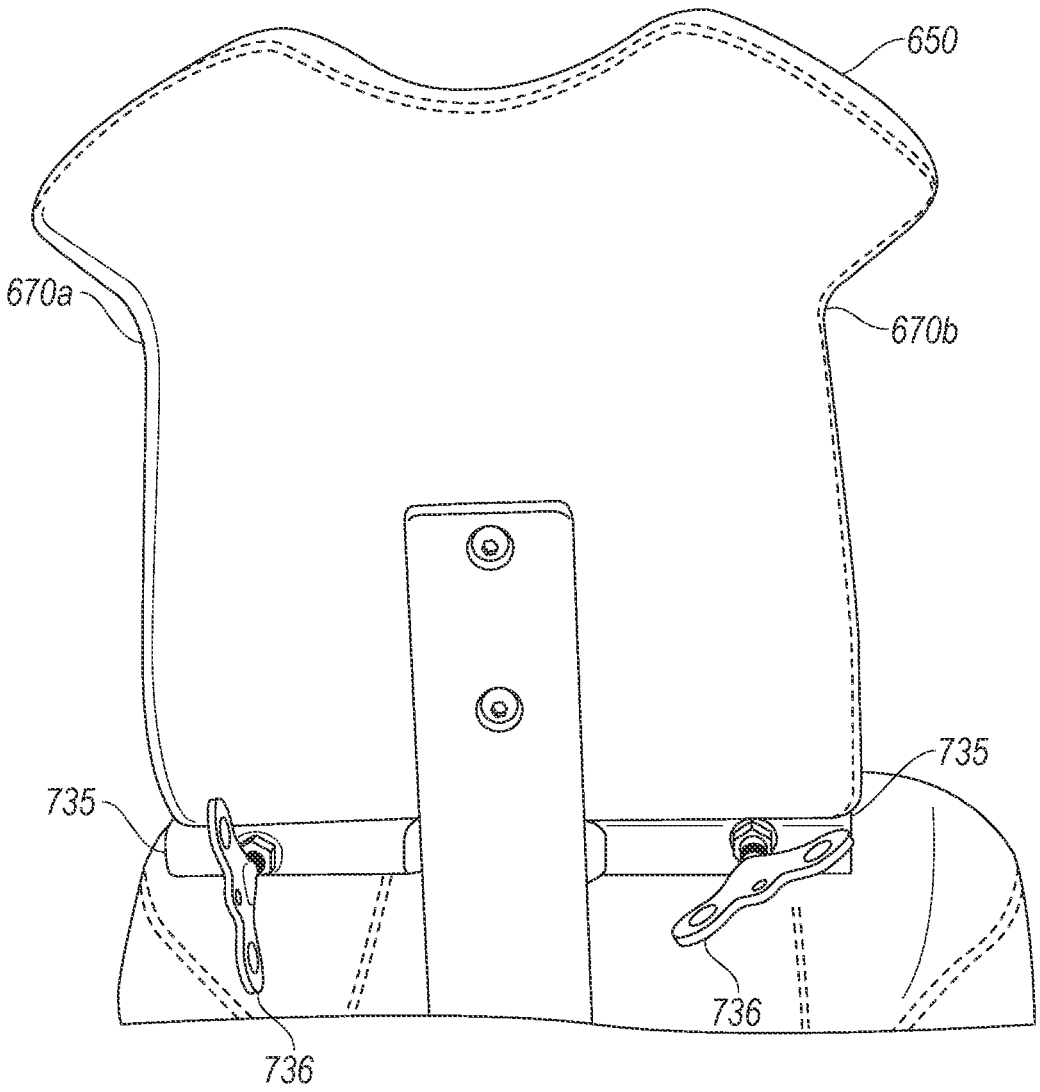
FIG. 28 is a front view of the chest support with armrests removed.

Additionally, when the locking devices 736 are unlocked, the armrests 610 can be removed from the chest support 650. FIG. 28 is a front view of the chest support 650 after the armrests 610*a*, 610*b* have been removed. When a user faces the chest support 650, the user's chest and shoulders can rest comfortably against the chest support 650 while the user's arms are unencumbered to provide a relatively large amount of arm movement. For example, the armrest-receiving portions 670*a*, 670*b* provide openings through which the user's arms can freely pass. The armrests 610 can be reinstalled by inserting the rods in the respective receivers 735 and sliding the rods to the desired position. Once the armrests 610 are at the desired location, the locking devices 736 can lock the armrests 610 to inhibit lateral movement of the armrests 610 relative to the chest support 650.

Figure 29:
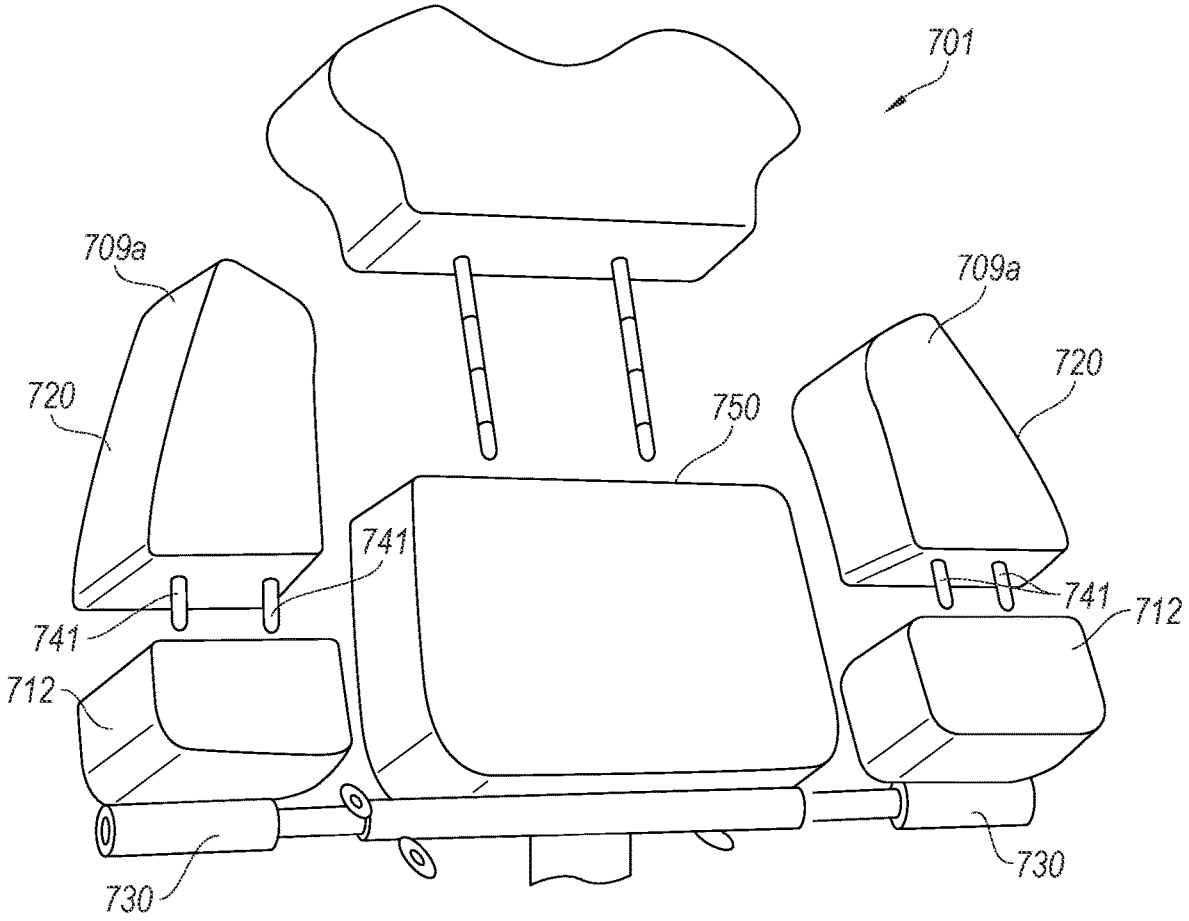
FIG. 29 is an isometric view of a portion of a stool with multi-piece armrests.

FIG. 29 is an isometric view of a portion of a stool 701 with extendable armrests. The stool 701 can be generally similar to the stool 600 of FIG. 22 except as detailed below. The stool 701 includes multi-piece armrests 709*a*, 709*b* (collectively "armrests 709") on opposite sides of a chest support 750. Each armrest 709 can include a base 712 and a movable elongate body 720. The base 712 can be connected to the chest support 750 by armrest positioner assemblies or connectors 730. The elongate bodies 720 can each include one or more rods or connectors 741 that can be inserted into corresponding openings (not shown) in the base 712. In some embodiments, the rods 750 can have notches or other features for locking the elongate body 720 at different positions relative to the bases 712. The armrests 709 can be moved from an unextended configuration in which the elongate bodies 720 are adjacent to or contact the bases 712 to an extended configuration in which the elongate bodies 720 are spaced apart from the bases 712. To remove one of the elongate bodies 720, that connectors 741 can be pulled out of the base 712. Other stools disclosed herein can also have multi-piece armrests with portions that can be moved away from or towards one another.

Figure 30:
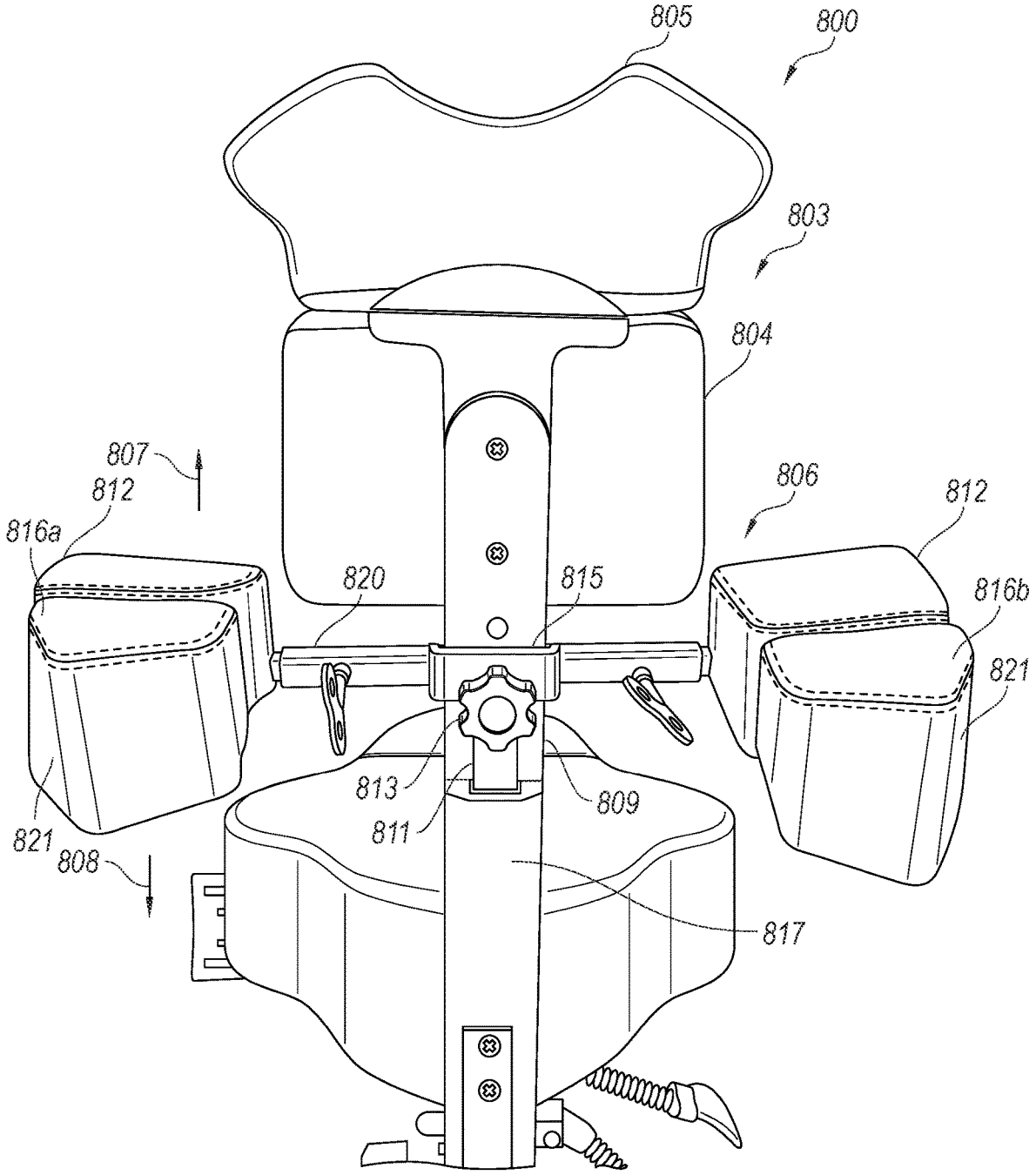
FIG. 30 is a front view of an upper portion of a stool with a vertically movable armrest assembly in accordance with an embodiment of the present technology.

FIG. 30 is a front view of a stool 800 with a movable armrest assembly 806 in accordance with an embodiment of the present technology. The stool 800 can be generally similar to the stools discussed herein. For example, the description of the stools discussed in connection with FIGS. 15-29 applies to the stool 800 unless indicated otherwise. The armrest assembly 806 can be positioned at different heights to support the user's arms, upper body, hands, or other body parts. The armrest assembly 806 can be moved and reconfigured provide desired support. As such, the stool 800 can serve as a universal stool for performing different tasks.

Referring now to FIG. 30, the stool 800 can include a chest assembly 803 with a chest support 804, upper chest support member 805, and a connector or an elongate support 809 ("elongate support 809"). The armrest assembly 806 in a locked state can be coupled (e.g., fixedly coupled) to the elongate support 809 and in an unlocked state can be moved (indicated by arrows 807, 808) along the elongate support 809. The armrest assembly 806 can be switched between the locked and unlocked states to move it vertically between various positions defined by features (e.g., holes, openings, slots, etc.) of the elongate support 809.

The armrest assembly 806 can include a locking mechanism 813, a crossbar assembly 820, and armrests 816*a*, 816*b* (collectively "armrests 816") on opposite sides of the chest support 804. Each armrest 816 can include a base 812 and movable body 821, The base 812 can be connected to the chest support 804 by armrest positioner assemblies, connectors, rods, combinations thereof, or the like. The crossbar assembly 820 can include one or more tubular members, rods, or the like. The locking mechanism 813 can include a collar 815 and one or more spring-loaded pins, brackets, clamps, locks, combinations thereof, or the like. The collar 815 can partially or completely surround the elongate support 809.

The armrest assembly 806 can also include a guide 811 that extends into a holder 817. The guide 811 can include an elongate member 809 slidably received by the holder 817. The guide 811 can inhibit, limit, or substantially prevent lateral movement of the collar 815 relative to the support 809 when the locking mechanism 813 is in a locked configuration. In some embodiments, the guide 811 can be removed, and the collar 815 can be configured for desired fit with the support 809.

The configuration of the arm assemblies, whether single piece or multi-piece, can be selected based on the desired support, and the arm assemblies can have non-expandable configurations. For example, the armrests 816*a*, 816*b* can be similar to the armrests 110*a*, 110*b* discussed in connection with FIG. 1-7 or other armrests disclosed herein.

Figure 31:
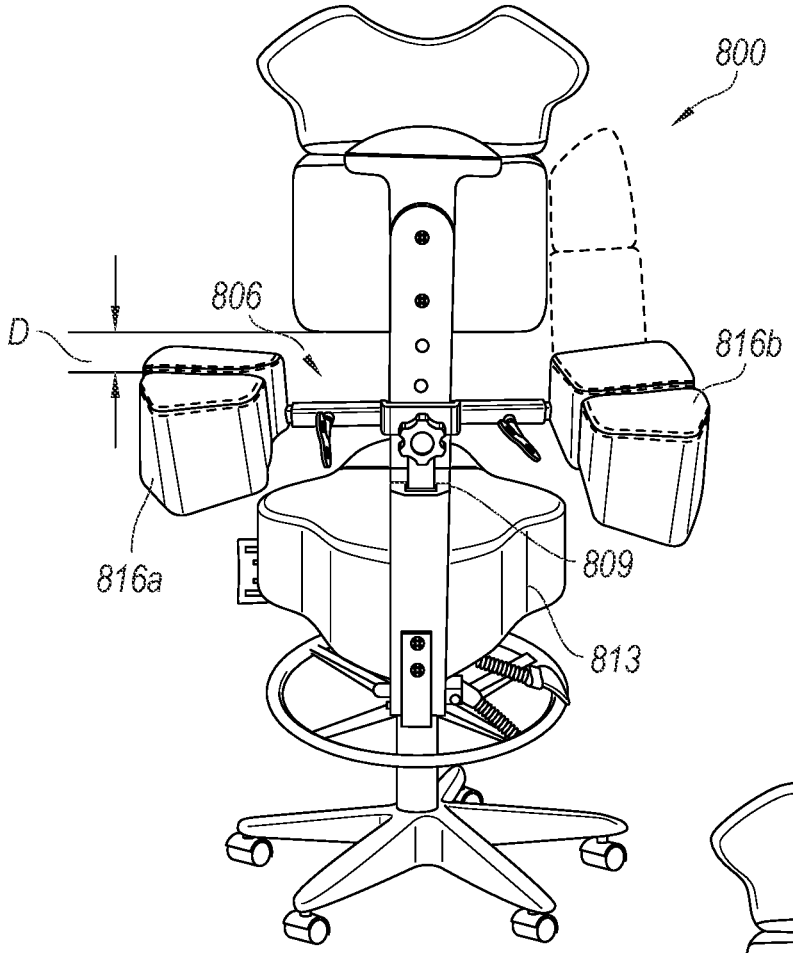
FIG. 31 is a front view of the armrest assembly of FIG. 30 in a lowered position.
Figure 32:
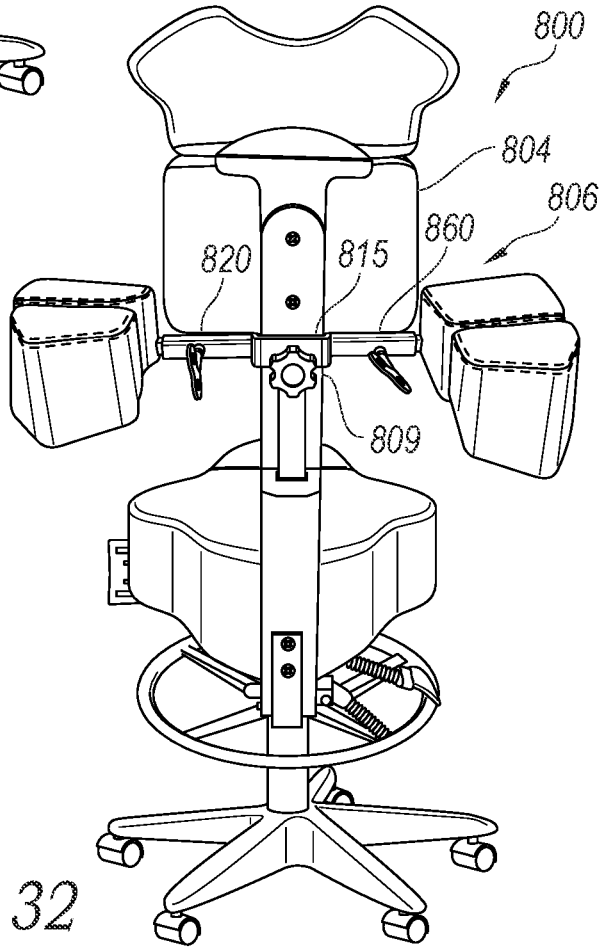
FIG. 32 is a front view of the armrest assembly in a raised position.

FIG. 30 shows the armrest assembly 806 is a middle or mid-level vertical position. FIG. 31 shows the armrest assembly 806 in a fully lowered position. FIG. 32 shows the armrest assembly 806 in a fully raised position. Referring now to FIG. 31, the deployed armrests 816 can be positioned below the bottom of the chest support 804 a distance D. The distance D can be equal to or greater than about 1 inch (2.5 cm), about 2 inches (5 cm), about 3 inches (7.6 cm), or about 4 inches (10.1 cm). The stool can be configured to provide other distances D, and the distance D (e.g., the maximum distance D when the armrest assembly 806 is fully lowered and one or both armrest 816 are at horizontal orientations) can be selected based on the desired lowered position. The armrests 816 can be individually moved between different heights, angular positions, etc. For example, the armrest 816*a* can be at a lowered or deployed position while the armrest 816*b* is at raised or stowed position (indicated in phantom line).

Referring now to FIG. 32, the collar 815 can be adjacent a bottom 860 of the chest support 804. When the user's chest rests against the chest support 804, the collar 815 and the user's chest are on opposite sides of the chest support 804. The locking mechanism 813 remains accessible to a user sitting on the stool 800.

Figure 33:
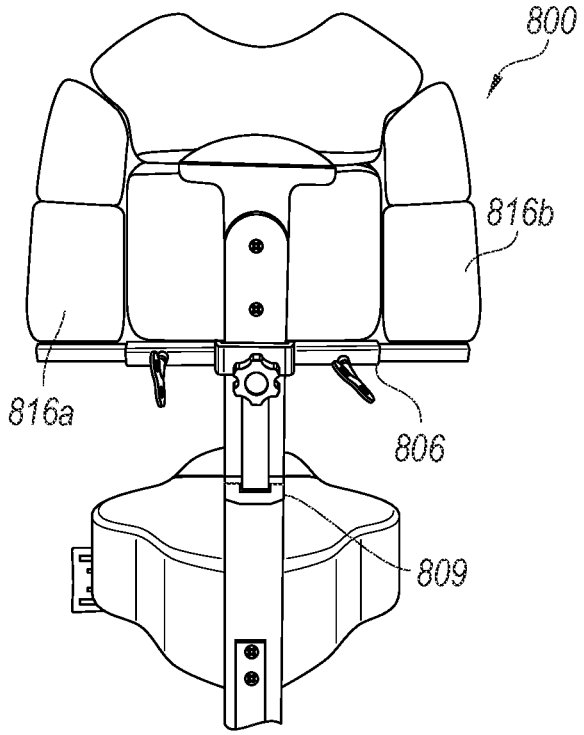
FIG. 33 is a front view of the stool with stowed armrests and the armrest assembly in the raised position.
Figure 33A:
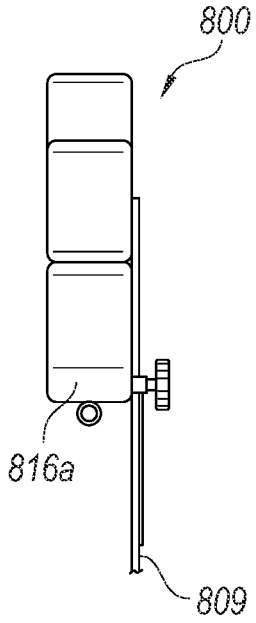
FIG. 33A is a side view of the upper portion of the stool of FIG. 33.
Figure 34:
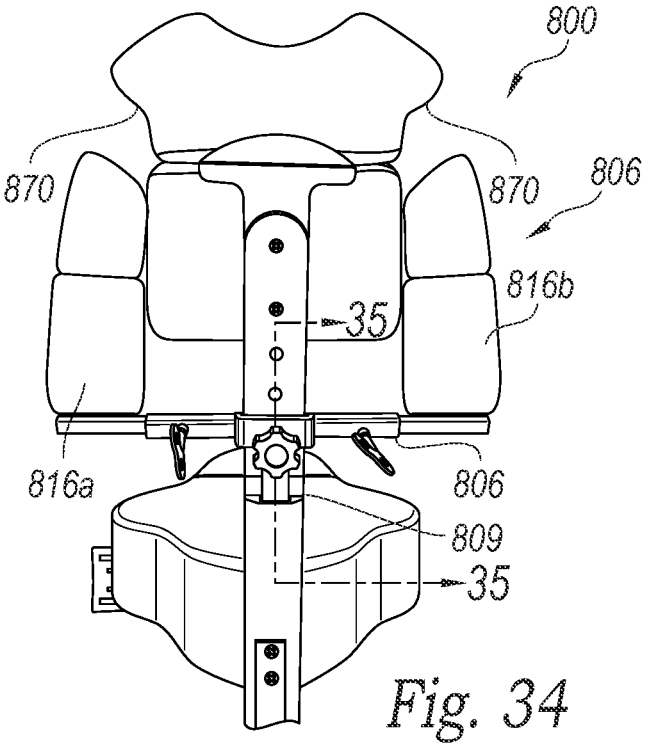
FIG. 34 is a front view of the upper portion of the stool with deployed armrests and the armrest assembly in the lowered position.

FIGS. 33 and 33A are front and side views, respectively, of the stool 800 with the armrest assembly 806 in the raised position. FIG. 34 is a front view of the stool 800 with the armrest assembly 806 in the lowered position. Referring now to FIG. 33, the stowed armrest 816 and chest sections are nested together to provide a generally continues support surface for contacting the user's torso. The armrests 816 (illustrated in the stowed positions) are received by the respective receiving regions or armrest-receiving openings 870 (FIG. 34). The periphery of the armrest-receiving features 870 can generally match or be geometrically congruent to the periphery of the armrests 816. This provides a generally gapless interface when the armrests 816 are stowed. The armrest assembly 806 can be lowered to move the armrests 816 away from the respective armrest-receiving features 870 (FIG. 34).

Figure 35:
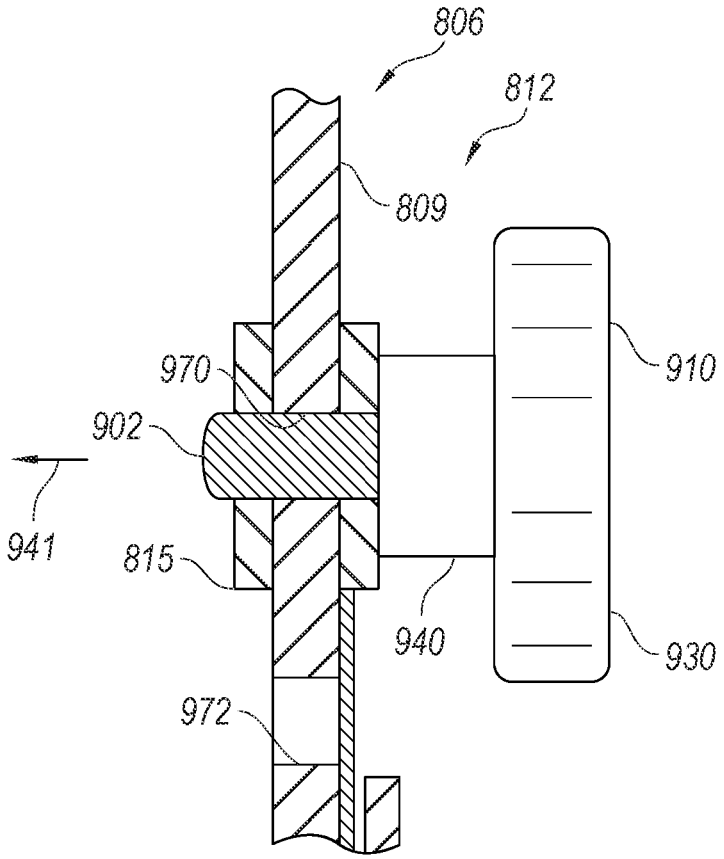
FIG. 35 is a partial cross-sectional view of the armrest assembly along line 35-35 of FIG. 34 in accordance with an embodiment of the present technology.

FIG. 35 is a partial cross-sectional view of the armrest assembly taken along line 35-35 of FIG. 34 in accordance with an embodiment of the present technology. The locking mechanism 812 can include the collar 815, a pin 902, and a knob assembly 910. The collar 815 can surround the elongate support 809, which can have one or more holes 970, 972 (or other features) for receiving the pin 902. The number, positions, and configuration of the holes can be selected based on the desired preset positions for the armrest assembly. Each hole 970, 972 can define a vertical position of the armrest assembly. The knob assembly 910 can include a knob or other gripping feature 930 ("knob 930") and a biasing mechanism 940. In some embodiments, the biasing mechanism 940 can bias the pin 902 toward a locked position. For example, one or more internal springs of the biasing mechanism 940 can push the pin 920 in the direction indicated by arrow 941. A user can pull on the knob 930 to overcome the biasing to move the pin 920 in the opposite direction, thereby pulling the pin 902 out of the hole 970. Once the pin 902 has been removed from the hole 970, the armrest assembly 806 can be moved vertically. For example, the armrest assembly 806 can be moved downwardly until the pin 920 is aligned with the hole 972. The user can allow the biasing mechanism 940 to move the pin 920 into the hole 972, thereby locking the armrest assembly 806 at another position.

Although the stool 800 has a single locking mechanism 812 for positioning both armrests 816, the stool 800 can have armrest assemblies that allow independent translation of the armrests. The armrest can be concurrently or sequentially moved. In some embodiments, the stool 800 has a plurality of locking mechanisms 812, each configured to position one armrest. Armrest assemblies can include one or more armrest positioner assemblies, locking devices (e.g., locking devices 736 discussed in connection with FIG. 27), extendable rods for laterally moving armrests, fasteners, or combinations thereof. Features from one chair or stool can be used in other embodiments disclosed herein. For example, stools 100, 300, or 400 can include translatable armrest assemblies. By way of another example, the stool 800 can have the chest assembly 150 described in connection with FIGS. 1 and 2. The configuration, features, and functionality of the stools, chairs, or other support assemblies can be selected based on its intended use, size of the user, or the like.

Figure 36:
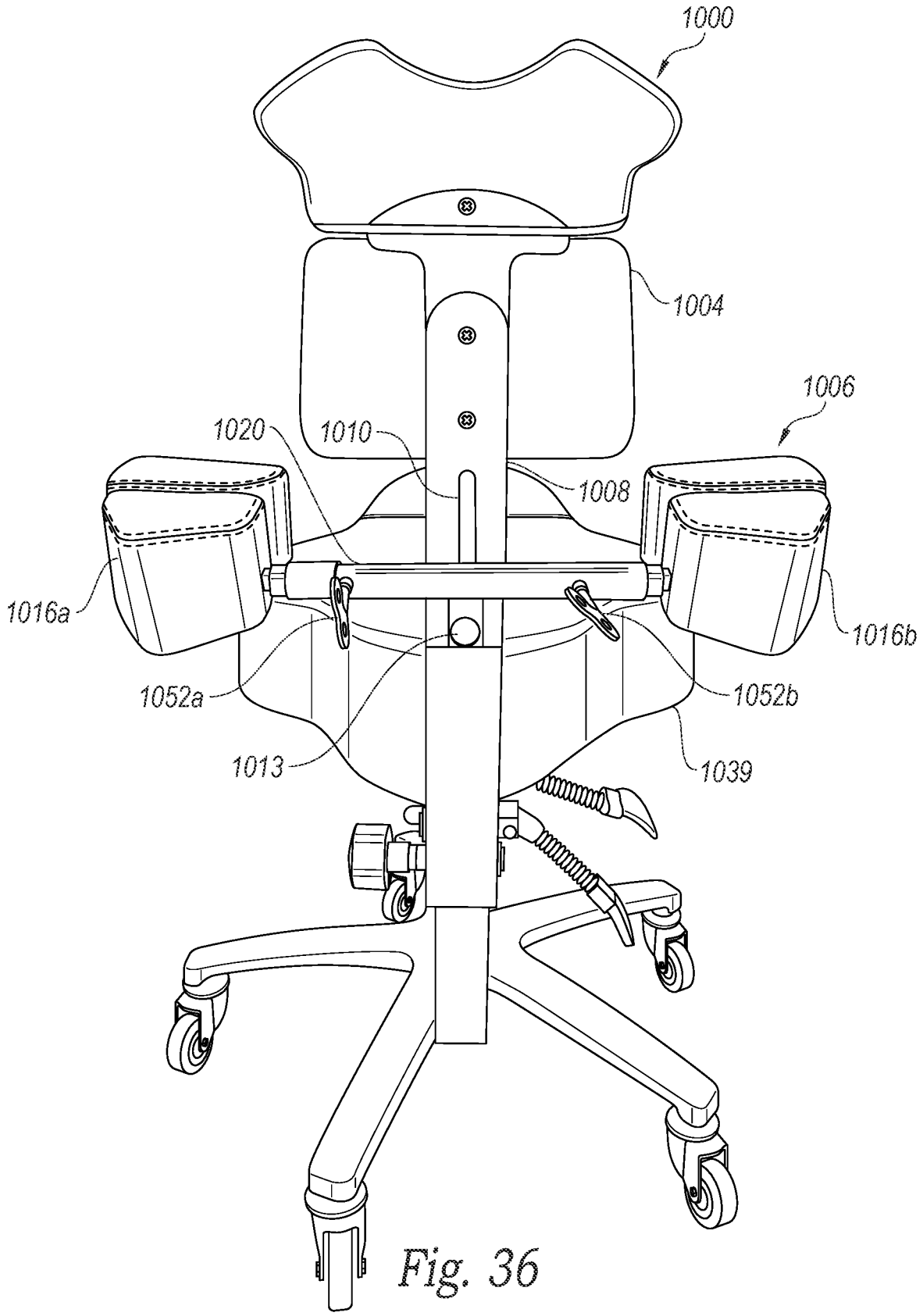
FIG. 36 is a front view of a stool with a vertically-movable armrest assembly in accordance with another embodiment of the present technology.

FIG. 36 is a front view of a stool 1000 with a vertically-adjustable armrest assembly 1006. The stool 1000 can be generally similar to the stool 800 discussed in connection with FIGS. 30-35, except as detailed below. The armrest assembly 1006 can be positioned at different heights suitable for supporting the user's body, such as the user's arms, upper body, hands, or other body parts. The armrest assembly 1006 can be set at preset positions along an elongate member 1008. The armrest assembly 1006 in a locked state can be fixedly coupled to elongate member 1008 and in an unlocked state can move along the elongate member 1008. In contrast to the discrete positioning provided by the stool 800 discussed in connection with FIGS. 30-35, the armrest assembly 1006 can be positioned at any location along a slot 1010, illustrated as an elongate slot, of the elongate member 1008, thereby providing fine adjustments of height adjustments.

The armrest assembly 1006 can include a locking mechanism 1013, a support or crossbar 1020, and armrests 1016*a*, 1016*b* (collectively "armrest 1016") on opposite sides of a chest support 1004. A user can sit on a seat assembly 1039 with the user's legs positioned directly underneath the chest support 1004. The user can move the armrests 1016*a*, 1016*b* outwardly or inwardly by unlocking extension mechanisms 1052*a*, 1052*b*.

Figure 37:
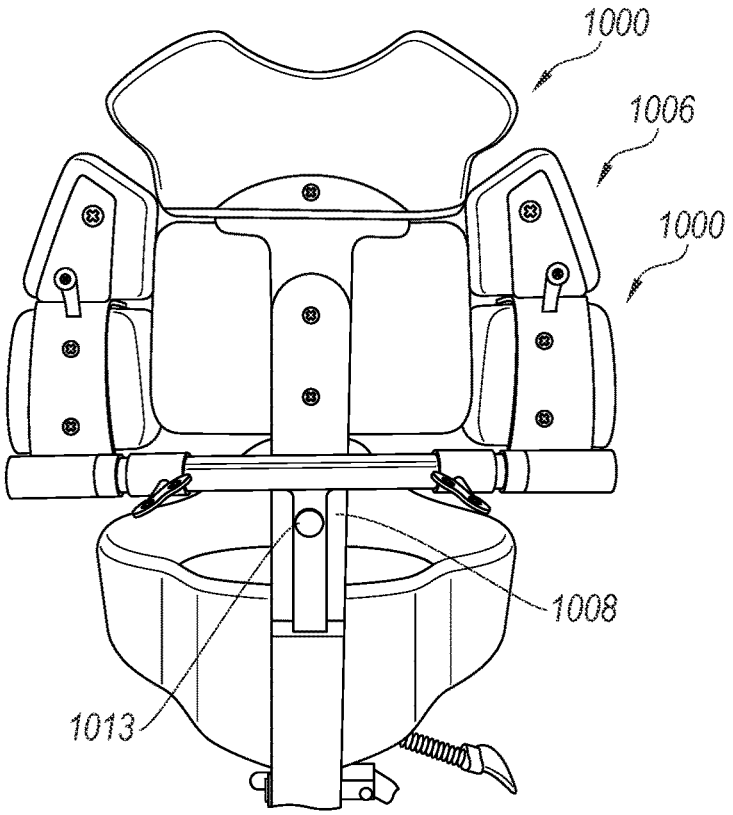
FIG. 37 is a front view of an upper portion of the stool of FIG. 36 with the armrest assembly in a raised position.

FIG. 37 is a front view of the armrest assembly 1006 at a fully raised position. The locking mechanism 1013 can clamp onto the elongated member 1008 and allows the user to remain seated while the front of the stool is positioned closely to a client (or furniture) that can obstruct access to the stool's front side. For example, a knob, a release pin, a threaded member, or another coupler can be accessible from the back side of the stool 1000. When the locking mechanism 1013 is unlocked, the armrest assembly 1006 can be moved along the elongate member 1008.

Figure 38:
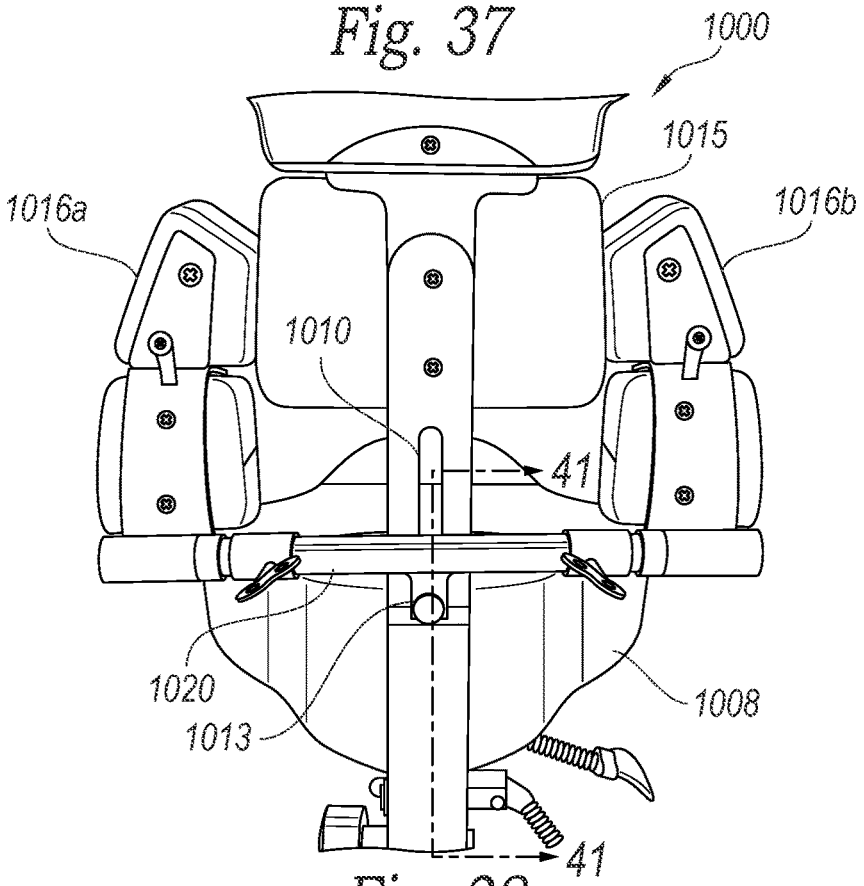
FIG. 38 is a front view of the upper portion of the stool with the armrest assembly in a lowered position.

FIG. 38 is a front view of the armrest assembly 1016 at a fully lowered position. The armrests 1016 can be locked at any desired position between the raised position of FIG. 37 and the lowered position of FIG. 36. The slot 1010 can extend upwardly along the upper pad 1015 to allow the armrest assembly 1006 to be positioned in front of the upper pad 1015.

Figure 39:
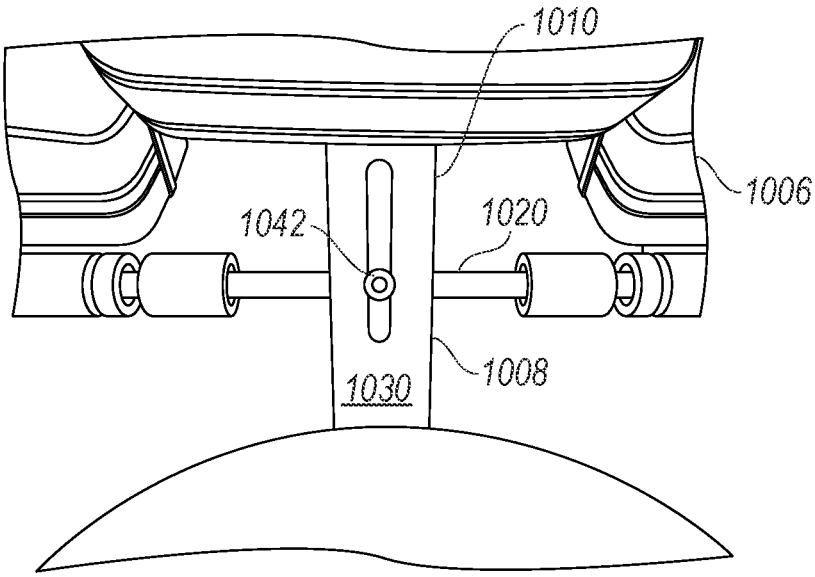
FIG. 39 is a back view of an armrest assembly interface of the stool.
Figure 40:
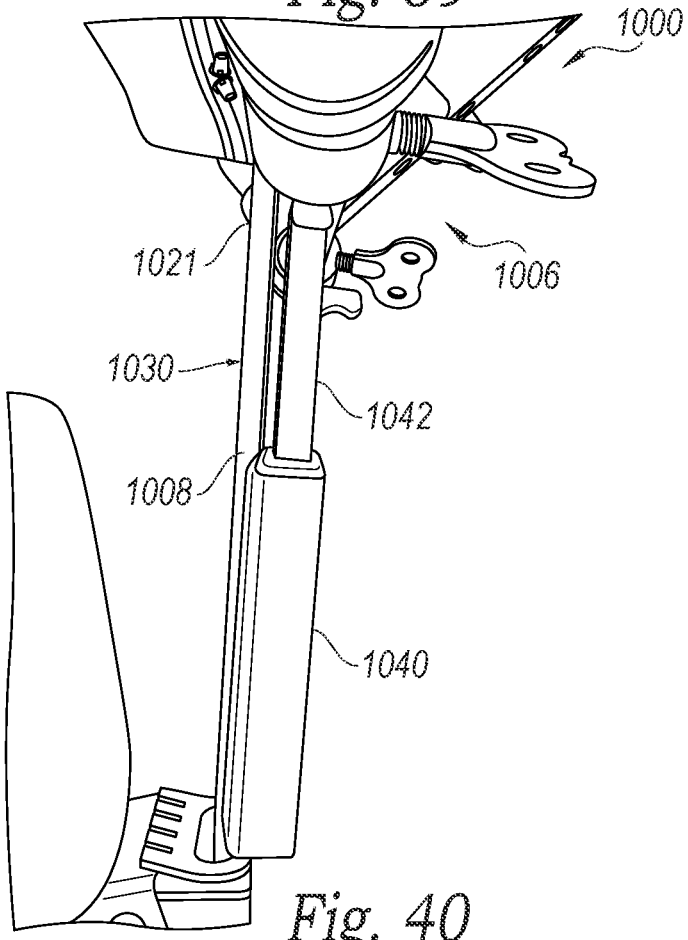
FIG. 40 is a side view of the upper portion of the stool in accordance with an embodiment of the present technology.
Figure 41:
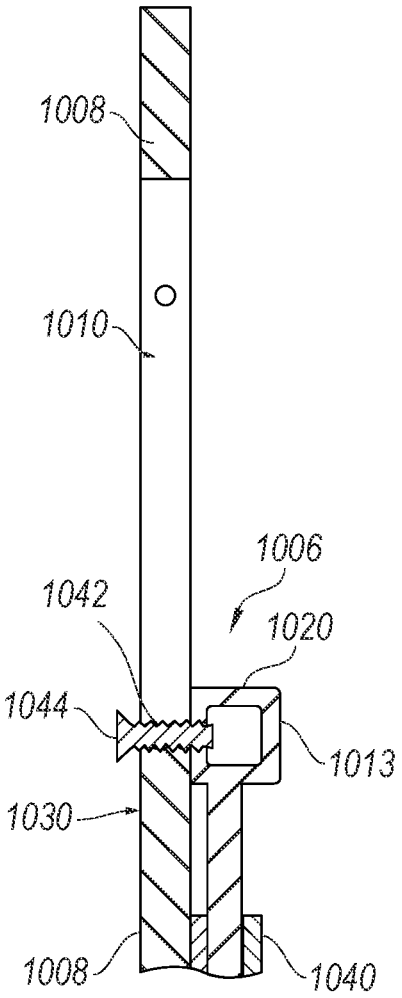
FIG. 41 is a partial cross-sectional view of the armrest assembly taken along a line 40-40 of FIG. 38.

FIG. 39 is a back view of the armrest assembly 1006. FIG. 40 is a side view of the portion of the stool 1000 with the elongate member 1008. FIG. 41 is a partial cross-sectional view of the armrest assembly taken along a line 41-41 of FIG. 38. Referring to FIG. 40, the armrest assembly 1006 can include a positioning mechanism in the form a guide or coupler 1042 connected to the cross member or crossbar 1020 (FIG. 39). The coupler 1042 (FIG. 40) is positioned in the slot 1010 and can have a head 1044 positioned on a back side of the elongate member 1008. The coupler 1042 can be temporarily or permanently coupled to the elongate member 1008.

FIG. 41 is a partial cross-sectional view of the armrest assembly 1006 taken along a line 41-41 of FIG. 38. The user can also set the vertical position of the armrest assembly 1006 by operating the locking mechanism 1013. The coupler 1042 can be in the form of a threaded member (e.g., an externally threaded member, a bolt, or the like) with a head 1044 that engages a backside 1030 of the elongate member 1008. A tool (e.g., a wrench, an Allen wrench, a screwdriver, or the like) can be used to rotate the coupler 1042. For example, the coupler 1042 can be rotated in a counterclockwise direction to unlock the locking mechanism 1013 and can be rotated in a clockwise direction to clamp onto the elongate member 1008. When the locking mechanism 1013 is unlocked, the armrest assembly 1006 can be raised to a desired height. Once positioned, the armrest assembly 1006 can be locked. The stool can be reconfigured any number of times during a single session or multiple sessions.

The armrest assemblies 1016 are movable along most of the distance between the chest support and seat assembly. The armrest disclosed herein can be positioned at different heights. For example, the armrest assembly 1006 can have two locking mechanisms for allowing for the armrests 1016 to be positioned at different heights. For example, the armrest 1016*a* of FIG. 36 can be connected to the elongate support 1008 by a first locking mechanism, and the armrest 1016*b* can be connected to the elongate support 1008 by another locking mechanism. Each locking mechanism can be operated for independent movement (e.g., vertical translation) of its corresponding armrest 1016.

A user can remain seated while adjusting the armrest assembly, armrest, or other components, such as the chest support. For example, elongated connectors disclosed herein can have one or more extenders, locking mechanisms, slides, or rails for repositioning the chest assembly. This allows positioning of armrests and chest assembly at various locations for different support positions, as well as users of different sizes. The locking mechanisms can be configured for front side operation as discussed in connection with FIGS. 30-35 or back side operation as discussed in connection with FIGS. 36-41.

Stools can have one or more motorized components. Locking mechanisms, positioners, and other components disclosed herein can be replaced with or include motorized devices (e.g., motors, actuators, or the like) to move stools between different configurations. By way of example, the stool 800 or stool 1000 can include a motorized device for raising and lowering armrest assemblies. Additionally or alternatively, seat assemblies, chest assemblies, or other assemblies can also include motorized components. For example, the chest assembly 803 of FIG. 30 can include one or more motorized devices for positioning one or both pads 8004, 8005. A user can use a controller to move the stool assembly to a specific configuration or to a preset configuration. Controllers, functionality, and components disclosed in U.S. application Ser. No. 15/004,837 can be incorporated into or used with the embodiments disclosed herein. U.S. application Ser. No. 15/004,837 is incorporated by reference herein in its entirety.

The stools 100, 300, 400, and 800 discussed above can also include extension mechanisms for adjusting the lateral position of armrests. For example, the stool 100 of FIG. 1 can include extension mechanisms that allow simultaneous or sequential horizontal movement of the armrests to provide additional ergonomic positions for the user. The stools and chairs discussed herein can be used in a wide range of settings, including tattoo parlors, medical settings, massage parlors, salons, spas, or other desired settings. In tattoo parlors, a person receiving a tattoo can sit on the stools discussed in connection with FIGS. 1-13, 15-28 and 30-35 or the chair discussed in connection with FIG. 14. In a single tattoo session, stools 100, 300, 400, 600, 700, 800, or chair 500 can be alternatively used by the client. The client and tattoo artists can simultaneously sit on stools or chairs disclosed herein. In medical settings, patients and/or medical practitioners (e.g., physicians, nurses, etc.) can sit on stools disclosed herein. In some procedures in which a physician inspects or operates on a patient's arm, the patient can sit on one of the stools disclosed herein and the armrest can help support the patient's arm at a desired position. The physician can apply a relatively large amount of pressure to the patient's arm without causing significant movement of the patient's arm. Additionally, straps, restraints, or other features can be incorporated into the armrests (or other components of the stools or chairs) to inhibit or limit movement of the user's arms or other body parts. The stools and chairs disclosed herein can also be used to support a user's arms when typing or performing other repetitive tasks that can often cause discomfort or pain. Advantageously, all or some of the support elements of the stools can be positioned independent of one another. This allows for a wide range of configurations. The seat assemblies disclosed herein can have positioners used to adjust the relative position of the seat assemblies.

Accordingly, the embodiments, features, and methods and techniques described herein may be incorporated into other types of support apparatuses (e.g., stools and chairs) used in a wide range of settings. In some embodiments, the apparatuses disclosed herein include one or more of the features, systems, devices, materials, methods and techniques described in U.S. patent application Ser. No. 12/876,953 (now U.S. Pat. No. 8,651,569), U.S. application Ser. No. 14/151,753 (now U.S. Pat. No. 9,084,486), U.S. application Ser. No. 15/121,754, U.S. application Ser. No. 15/004,837, U.S. application Ser. No. 15/727,896, U.S. application Ser. No. 15/248,824, App. No. PCT/US2015/10910, International Application No. PCT/US2019/018100, U.S. Provisional Patent Application No. 62/048,184, U.S. Provisional Patent Application No. 62/729,253, and U.S. Application No. 62/630,801, which are incorporated herein by reference in their entireties. For example, the stools and chairs discussed herein can include hydraulics systems, hinges, locking mechanisms, or other components disclosed in U.S. patent application Ser. No. 12/876,953. In some procedures, a person receiving a tattoo can be supported by one of the apparatuses disclosed in U.S. patent application Ser. No. 12/876,953 while the tattoo artist sits on the stools disclosed herein. In addition, the embodiments, features, systems, devices, materials, methods and techniques described herein may, in certain embodiments, be applied to or used in connection with any one or more of the embodiments, features, systems, devices, materials, methods and techniques disclosed in the above-mentioned U.S. patent application Ser. No. 12/876,953.

Unless the word "or" is expressly limited to mean only a single item exclusive from the other items in reference to a list of two or more items, then the use of "or" in such a list is to be interpreted as including (a) any single item in the list, (b) all of the items in the list, or (c) any combination of the items in the list. The term "comprising" is used throughout to mean including at least the recited feature(s) such that any greater number of the same feature and/or additional types of other features are not precluded. It will also be appreciated that specific embodiments have been described herein for purposes of illustration, but that various modifications may be made without deviating from the technology. Further, while advantages associated with certain embodiments of the technology have been described in the context of those embodiments, other embodiments may also exhibit such advantages, and not all embodiments need necessarily exhibit such advantages to fall within the scope of the technology. Accordingly, the disclosure and associated technology can encompass other embodiments not expressly shown or described herein. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. A stool comprising:

a seat assembly;

a chest support configured to support a user's chest; and an armrest assembly with a first armrest and a second armrest, wherein the armrest assembly is movable upwardly to position at least one of the first armrest or the second armrest at an upright position vertically alongside a respective side of the chest support such that the at least one of the first armrest or the second armrest is generally flush with the chest support to contact the user's chest when the user's chest is against the chest support, and wherein the armrest assembly is movable downward to position at least one of the first armrest or the second armrest at a lowered position below the chest support such that the at least one of the first armrest or the second armrest is located to support a portion of the user's arm below the chest support, and wherein the armrest assembly is translatable to a lowered position relative to the chest support to translate a bottom portion of the at least one of the first armrest of the second armrest away from the chest support while an upper portion of the least one of the first armrest of the second armrest remains generally flush with the chest support.

2. The stool of claim 1, wherein the armrest assembly includes a locking mechanism configured to lock the armrest assembly at a plurality of positions along a post connected to the chest support.

3. The stool of claim 1, wherein the armrest assembly is movable between a plurality of preset vertical positions relative to at least one of the chest support or the seat assembly.

4. The stool of claim 1, wherein the armrest assembly is translatable along an elongate member connected to the chest support independent of angular positions of the first armrest and/or the second armrest relative to the chest support.

5. The stool of claim 1, wherein the first armrest has multiple degrees of freedom.

6. The stool of claim 1, wherein the first armrest and the second armrest are translatable laterally outward away from the chest support.

7. A stool, comprising:

a chest support;

a seat assembly;

a vertical elongate member coupled to the chest support and the seat assembly; and an armrest assembly translatable along the vertical elongate member and having a locked state for locking the armrest assembly and an unlocked state for vertically moving the armrest assembly along the elongate member, wherein the armrest assembly includes at least one armrest positionable to support a user's arm positioned in front of the stool when the user sits on the seat assembly and the user's chest rests against a backside of the chest support, wherein the at least one armrest is movable laterally away from the chest support while the armrest assembly is fixedly coupled to the elongate member, and wherein the at least one armrest is positionable at a lowered position for supporting the user's arm and a stowed position for supporting the user's chest positioned against the backside of the chest support.

8. The stool of claim 7, wherein the at least one armrest is movable along most of a distance between the chest support and the seat assembly.

9. The stool of claim 7, wherein the armrest assembly includes a positioning mechanism operable to clamp onto the elongate member.

10. The stool of claim 7, wherein the at least one armrest is movable between a lowered position and a raised position, wherein the armrest assembly, in the unlocked state, is vertically movable when the at least one armrest is in either the lowered position or the raised position.

11. The stool of claim 7, wherein the armrest assembly is slidably disposed on the elongate member supporting the chest support, wherein the elongate member is configured to be straddled by the user facing the backside of the chest support.

12. The stool of claim 7, wherein the at least one armrest, in a deployed position, extends forwardly away from the user's chest when the user's chest contacts the backside of the chest support and one of the user's legs is positioned underneath the at least one armrest.

13. The stool of claim 7, wherein the armrest assembly includes a slider that allows the at least one armrest to slide laterally between lockable positions.

14. The stool of claim 7, wherein the armrest assembly includes at least one armrest that is translatable in different directions relative to the chest support.

15. The stool of claim 7, wherein the at least one armrest is rotatable relative to the chest support independent of vertical and lateral translation of the at least one armrest.

16. The stool of claim 7, wherein the at least one armrest is rotatable relative to the chest support independent of vertical translation and lateral translation of the at least one armrest.

17. The stool of claim 7, wherein the armrest assembly includes a slider assembly extendable to move the at least one armrest away from a post coupled to the chest support.

18. The stool of claim 17, wherein the armrest assembly is slidable along the elongate member between locking positions for locking to the elongate member.

19. A stool comprising:

a seat assembly;

a chest support configured to support a user's chest; and an armrest rotatable upwardly to position the armrest at an upright orientation alongside the chest support such that the armrest is generally flush with a backside of the chest support to contact the user's chest when the user's chest is against the backside of the chest support, wherein the armrest is rotatable downwardly to a forward orientation such that the armrest extends forwardly away from the chest support, wherein the armrest is translatable from a raised position to a lowered position while the armrest remains generally flush with the chest support, and wherein an arm-supporting surface of the armrest in the forward orientation and the lowered position is positioned lower than a bottom of the chest support.

20. The stool of claim 19, wherein when the armrest is in the forward orientation and lowered position, a distance between the arm-supporting surface and the bottom of the chest support is equal to or greater than 1 inch.

* * * * *